US011976463B1

(12) United States Patent
Attalla

(10) Patent No.: US 11,976,463 B1
(45) Date of Patent: May 7, 2024

(54) SUPPORT WALL FRAME SYSTEM AND ASSOCIATED USE THEREOF

(71) Applicant: Anthony Attalla, Navarre, FL (US)

(72) Inventor: Anthony Attalla, Navarre, FL (US)

( * ) Notice: Subject to any disclaimer, the term of this patent is extended or adjusted under 35 U.S.C. 154(b) by 0 days.

(21) Appl. No.: 18/545,410

(22) Filed: Dec. 19, 2023

Related U.S. Application Data

(63) Continuation-in-part of application No. 18/327,748, filed on Jun. 1, 2023, which is a continuation-in-part of application No. 16/653,721, filed on Oct. 15, 2019, now abandoned, which is a continuation-in-part of application No. 15/942,458, filed on Mar. 31, 2018, now Pat. No. 10,480,185.

(51) Int. Cl.

| | |
|---|---|
| ***E04B 2/60*** | (2006.01) |
| ***E04B 2/76*** | (2006.01) |
| ***E04C 3/32*** | (2006.01) |
| *E04C 3/04* | (2006.01) |

(52) U.S. Cl.
CPC ..... *E04B 2/60* (2013.01); *E04B 2/767* (2013.01); *E04C 3/32* (2013.01); *E04C 2003/0473* (2013.01)

(58) Field of Classification Search
CPC ..... E04B 2/60; E04B 2103/06; E04B 2/767; E04B 2001/2457; E04C 3/32; E04C 3/07; E04C 2003/0473; E04C 2003/047
USPC ..... 52/653.1
See application file for complete search history.

(56) References Cited

U.S. PATENT DOCUMENTS 3,845,601 A * 11/1974 Kostecky ..... E04B 1/2403 52/656.1
4,809,476 A * 3/1989 Satchell ..... E04B 2/76 52/843
4,854,096 A * 8/1989 Smolik ..... E04B 2/767 52/241
5,203,132 A * 4/1993 Smolik ..... E04B 2/7409 52/690
5,325,651 A * 7/1994 Meyer ..... E04C 3/32 52/696
5,335,469 A * 8/1994 Stuart ..... E04B 7/045 52/645
5,394,665 A * 3/1995 Johnson ..... E04C 3/32 52/745.1
5,797,233 A * 8/1998 Hascall ..... E04C 3/07 52/489.1

(Continued)

FOREIGN PATENT DOCUMENTS

WO WO-2007082366 A1 * 7/2007 ..... B21D 19/00

*Primary Examiner* — Brent W Herring
(74) *Attorney, Agent, or Firm* — Ashkan Najafi

(57) ABSTRACT

A support wall frame system includes at least one end track, and a frame member received within the at least one end track. Advantageously, the frame member is statically affixed to the at least one end track. The at least one track includes at least one detent spaced from each shoulder of the track to allow bending the at least one track from a single and unitary sheet of metal. Each of the bottom end track and the top end track includes a first opening disposed along a first shoulder of the track base and the first track side wall, and a second opening disposed along a second shoulder of the track base and the second track side wall. The first opening and the second opening each has a substantially cross-shape. A third opening may be formed along the track base.

17 Claims, 17 Drawing Sheets

(56) References Cited

U.S. PATENT DOCUMENTS

| | | | | |
|---|---|---|---|---|
| 6,023,898 | A * | 2/2000 | Josey | E04B 1/2403 52/657 |
| 6,568,138 | B1 * | 5/2003 | Frost | E04B 2/767 52/656.1 |
| 6,983,569 | B1 * | 1/2006 | Rosenberg | E04B 2/7457 52/241 |
| 8,733,044 | B2 * | 5/2014 | Dollerup | E04B 2/765 52/290 |
| 10,480,185 | B1 * | 11/2019 | Attalla | E04B 2/767 |
| 2007/0011971 | A1 * | 1/2007 | Sitkiewicz | E04B 2/767 52/481.1 |
| 2008/0006002 | A1 * | 1/2008 | Strickland | E04C 3/07 29/897 |
| 2008/0110126 | A1 * | 5/2008 | Howchin | E04C 3/32 52/630 |
| 2008/0168733 | A1 * | 7/2008 | Tollenaar | E04B 2/767 52/481.1 |
| 2009/0272054 | A1 * | 11/2009 | Swain, Jr. | E04C 2/20 52/309.1 |
| 2013/0000242 | A1 * | 1/2013 | Ferguson | E04C 3/07 52/653.1 |
| 2017/0037619 | A1 * | 2/2017 | Dietzen | E04C 3/11 |
| 2020/0095767 | A1 * | 3/2020 | Attalla | E04C 3/04 |
| 2022/0205239 | A1 * | 6/2022 | King | F16B 2/248 |

* cited by examiner

SUPPORT WALL FRAME SYSTEM AND ASSOCIATED USE THEREOF

CROSS REFERENCE TO RELATED APPLICATIONS

This is a continuation-in-part application of currently pending U.S. patent application Ser. No. 18/327,748, filed Jun. 1, 2023, which is a continuation-in-part application of U.S. patent application Ser. No. 16/653,721, filed Oct. 15, 2019, now abandoned, which is a continuation-in-part application of U.S. patent application Ser. No. 15/942,458, filed Mar. 31, 2018, now U.S. patent Ser. No. 10/480,185 issued on Nov. 19, 2019, the entire disclosures are incorporated by reference herein.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to stick-built construction frame systems and, more particularly, to a support wall frame system including at least one end track and a frame member connected thereto, wherein the frame member has a series of ribs and stiffeners to increase its shear strength so that the frame member resists twisting thereby preventing racking of the support wall.

Prior Art

Stick frame construction or simply stick construction is used for a large portion of the frame of a building, is used in a large percentage of smaller scale building construction projects. Stick construction utilizes studs, lightweight materials, typically either wood or metal, to construct the frame, including walls, floor joists and roof trusses of the building under construction, wood studs being typical in residential construction and metal studs being typical in commercial construction. Stick frame construction produces a building frame that has a relatively high strength to weight ratio.

While a strong frame can be produced using standard stick frame construction, there is room for improvement. One issue building design engineers grapple with is trying to increase the shear strength of the frame built, especially, the vertical or wall components of the frame. A stick frame constructed building is subject to in plane lateral forces, caused by wind and earthquakes. If such in plane force is sufficiently strong, the building can be subject to racking, wherein the walls of the building come out of square. Racking causes damage to carious components of the building, including the walls, both interior and exterior, cabinets, doors and windows, flooring, especially upper story flooring, and in extreme cases, structural failure.

In wood stick frame construction, engineers focus on the strength of the wood used to produce the stud as well as bracing the frame and the walls via sheathing and other methods, in order to increase the shear strength of the structure built in order to thereby reduce the potential for racking. In addition to these considerations, in metal stick construction, engineers also focus on the geometry of the frame, particularly the stud, to increase the overall shear strength of the stud and thereby increase overall shear strength of the frame produced.

Accordingly, a need remains for a frame system in order to overcome at least one aforementioned shortcoming. The exemplary embodiment(s) satisfy such a need by providing a support wall frame system including a frame member having a series of ribs and stiffeners and at least one end track connected to the frame member, that is convenient and easy to use, lightweight yet durable in design, versatile in its applications, and designed for increasing the frame members shear strength so that the frame member resists twisting and prevents racking of the support wall. The present disclosure provides non-obvious improvements to the subject matter disclosed in U.S. Pat. Nos. 5,315,804 and 10,480,185, and U.S. Published Patent Application Nos. US20040074200A1, US20050166524A1, US20060144009A1, and US20200095767A1 which were filed by the applicant of the present application.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a metal stud to be used in stick frame construction wherein the geometry of the stud, as well as the receiving portion of the end track that receives the stud, are designed to increase the shear strength of the stud and thus the overall support wall produced, for a given material used to produce the stud. These and other objects, features, and advantages of the non-limiting exemplary embodiment(s) are provided by a support wall frame system for providing increased shear strength thereby preventing twisting and racking of a support wall. Such a support wall frame system advantageously includes a metal frame member that is of relatively simple design and construction, being produced using standard manufacturing techniques, so that the metal frame stud is economically attractive to potential consumers for this type of product. Use of the metal frame member is relatively straightforward requiring only the standard skills application to metal stick frame. Special tools to produce the frame using the metal frame member of the present invention are not required.

The support wall frame system includes at least one end track, and a frame member received within the at least one end track and including an elongated stud having a stud base with a first stud side wall and a second stud side wall. Such an elongated stud includes a first rib located along the first stud side wall and a second rib located along the second stud side wall. Advantageously, the stud base is intercalated between the first rib and the second rib. Advantageously, the at least one end track includes a bottom end track and a top end track spaced therefrom. Advantageously, each of the bottom end track and the top end track includes a track base having a first track side wall and a second track side wall. Such a first track side wall has an inwardly directed first detent and the second track side wall having an inwardly directed second detent. Each of the first detent and the second detent is extended along a major longitudinal height of the first track side wall and the second track side wall, respectively. Advantageously, each of the bottom end track and the top end track includes a first opening disposed along a first shoulder of the track base and the first track side wall, and a second opening disposed along a second shoulder of the track base and the second track side wall. Advantageously, the first opening and the second opening each has a substantially cross-shape.

In a non-limiting exemplary embodiment, the first opening is contiguous with the first detent, the first shoulder, and the third detent.

In a non-limiting exemplary embodiment, the first opening includes a first rectilinear section located entirely at the first track side wall wherein the first rectilinear section is directly abutted with the first detent and oriented parallel thereto along an x-axis, a first horizontal rectilinear section located entirely along the first shoulder wherein the first horizontal rectilinear section being directly abutted with the first rectilinear section and oriented parallel to a y-axis, and a second rectilinear section located entirely at the track base wherein the second rectilinear section being directly abutted with the third detent and oriented perpendicular thereto along a z-axis.

In a non-limiting exemplary embodiment, the first rectilinear section and the second rectilinear section intersect a center of the first horizontal section In a non-limiting exemplary embodiment, the second opening is contiguous with the second detent, the second shoulder, and the third detent.

In a non-limiting exemplary embodiment, the second opening includes a third rectilinear section located entirely at the second track side wall wherein the third rectilinear section is directly abutted with the second detent and oriented parallel thereto along an x-axis, a second horizontal rectilinear section located entirely along the second shoulder wherein the second horizontal rectilinear section being directly abutted with the third rectilinear section and oriented parallel to a y-axis, and a fourth rectilinear section located entirely at the track base wherein the fourth rectilinear section being directly abutted with the third detent and oriented perpendicular thereto along a z-axis.

In a non-limiting exemplary embodiment, the third rectilinear section and the fourth rectilinear section intersect a center of the second horizontal section.

In a non-limiting exemplary embodiment, each of the bottom end track and the top end track further includes a third opening disposed along the track base. Advantageously, the third opening having axially opposed ends directly abutted to the first opening and the second opening.

In a non-limiting exemplary embodiment, the third opening is rectilinear and extends along an entire width of the track base.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
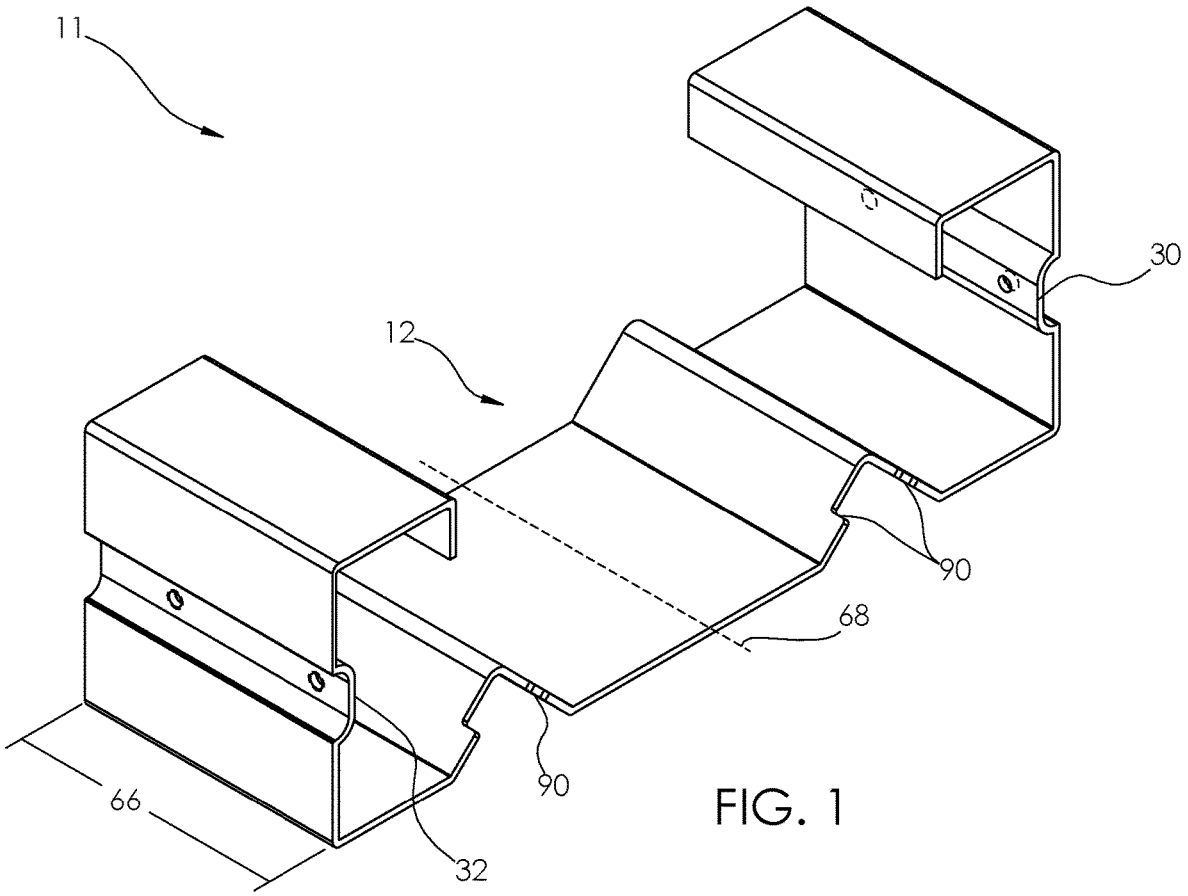
FIG. 1 is a perspective view of a frame member of a support wall frame system, in accordance with a non-limiting exemplary embodiment of the present disclosure.
Figure 2:
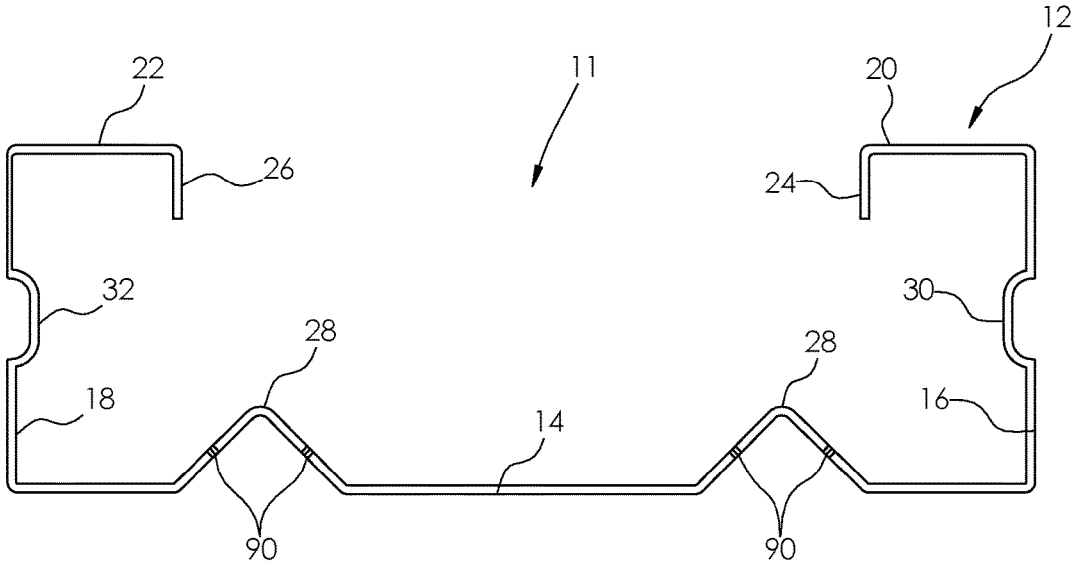
FIG. 2 is a top plan view of the frame member shown in FIG. 1.
Figure 3:
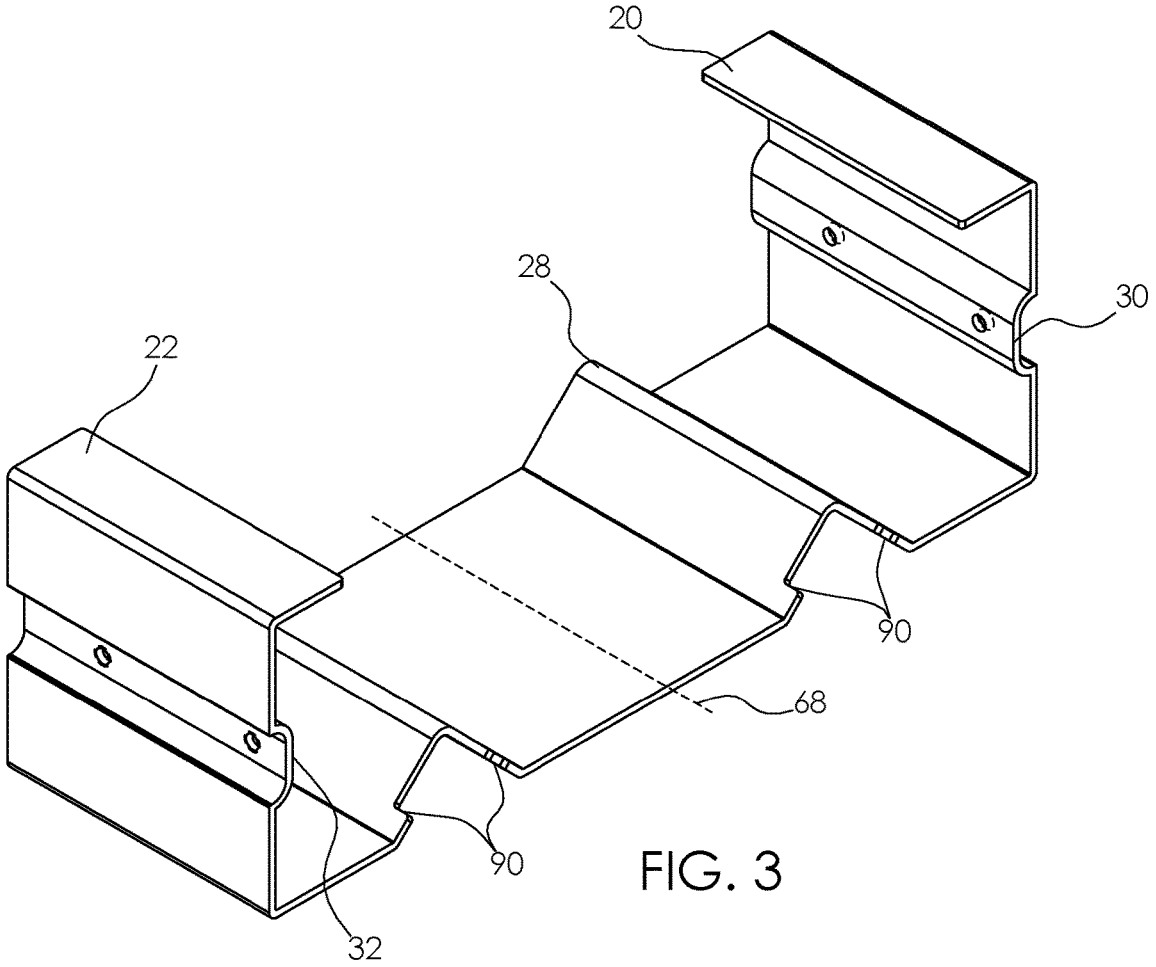
FIG. 3 is a perspective view of a frame member of a support wall frame system, in accordance with another non-limiting exemplary embodiment of the present disclosure.
Figure 4:
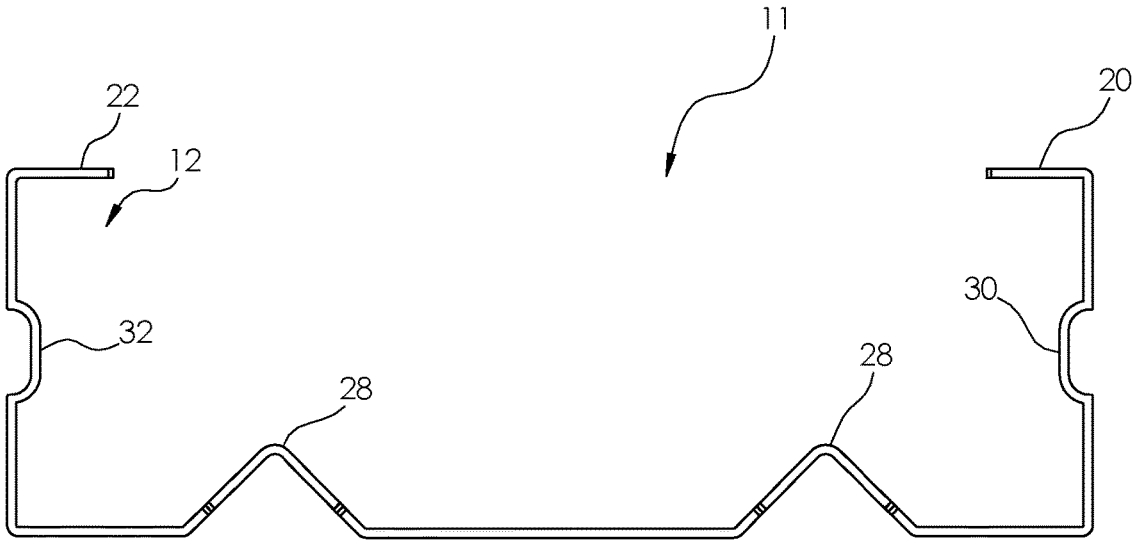
FIG. 4 is a top plan view of the frame member shown in FIG. 3.
Figure 5:
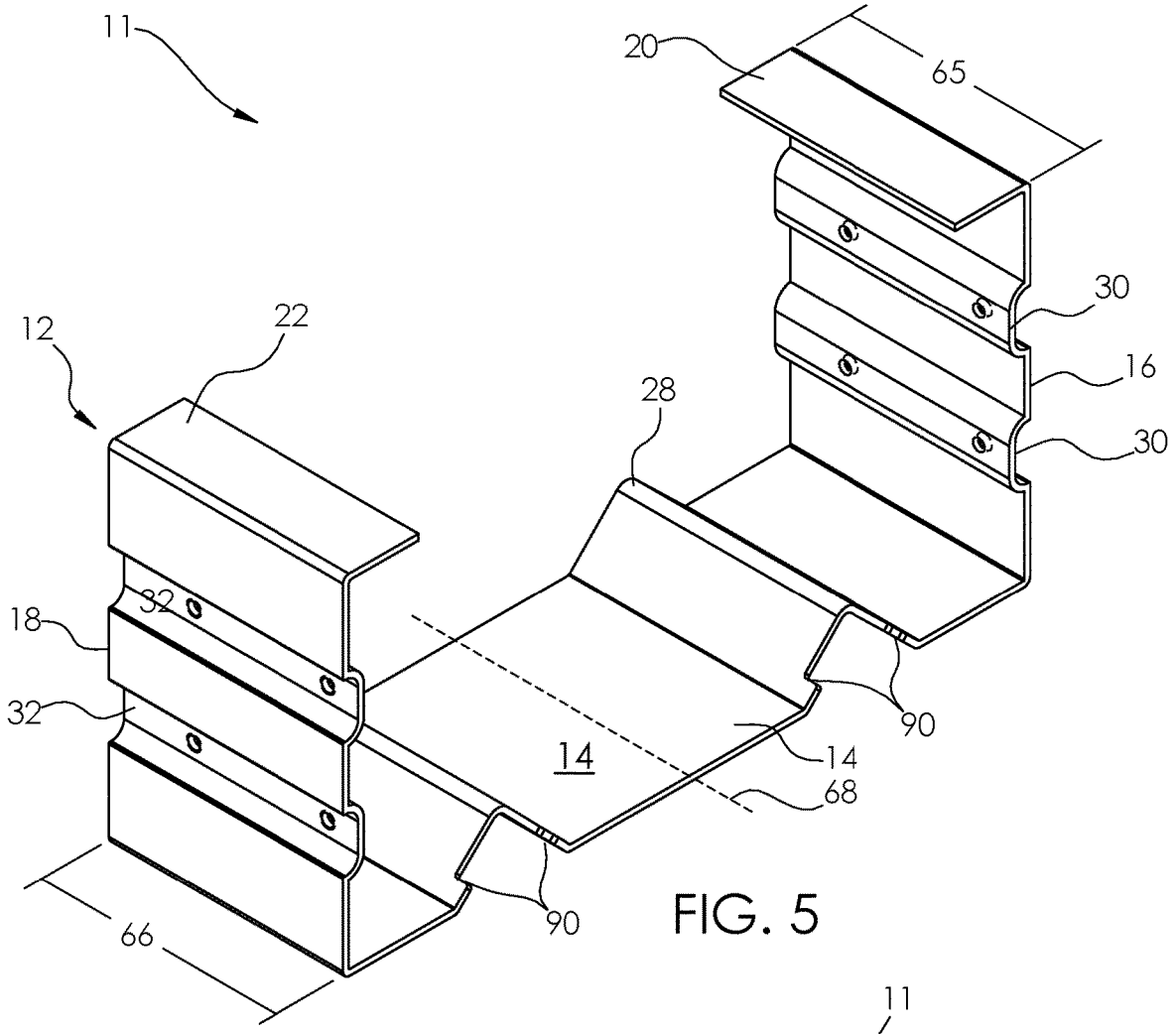
FIG. 5 is a perspective view of a frame member of a support wall frame system, in accordance with yet another non-limiting exemplary embodiment of the present disclosure.
Figure 6:
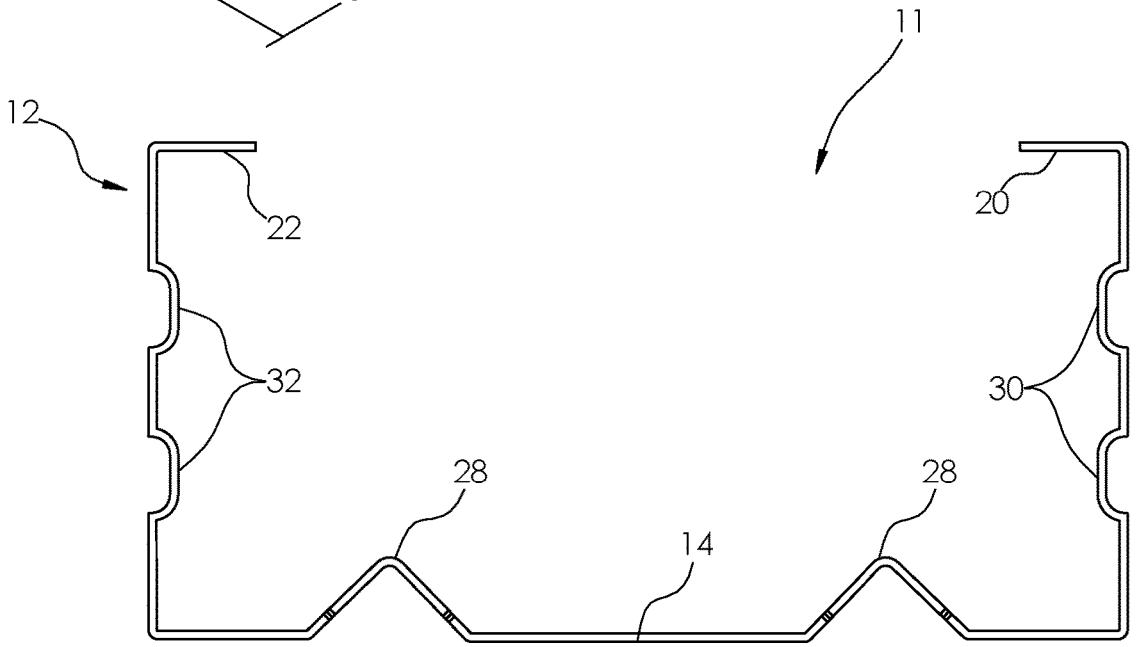
FIG. 6 is a top plan view of the frame member shown in FIG. 5.
Figure 7:
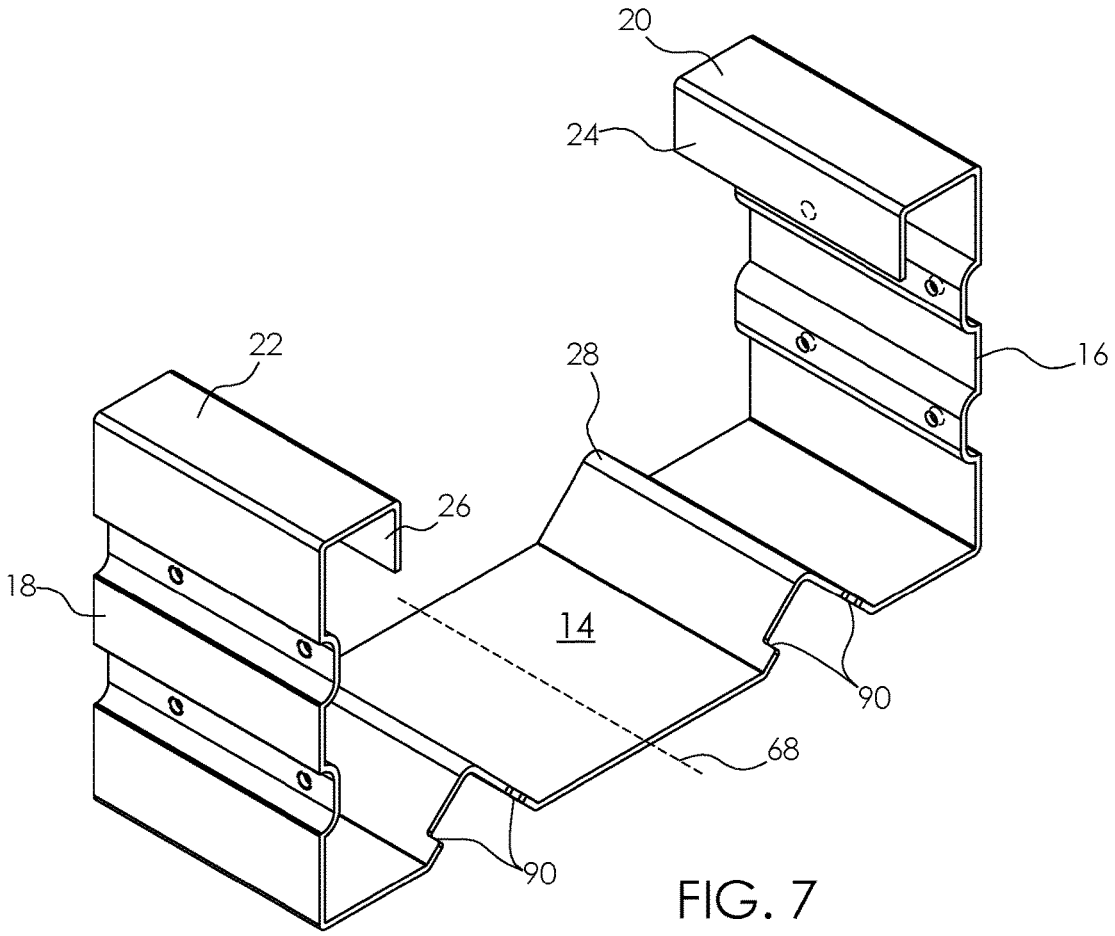
FIG. 7 is a perspective view of a frame member of a support wall frame system, in accordance with yet another non-limiting exemplary embodiment of the present disclosure.
Figure 8:
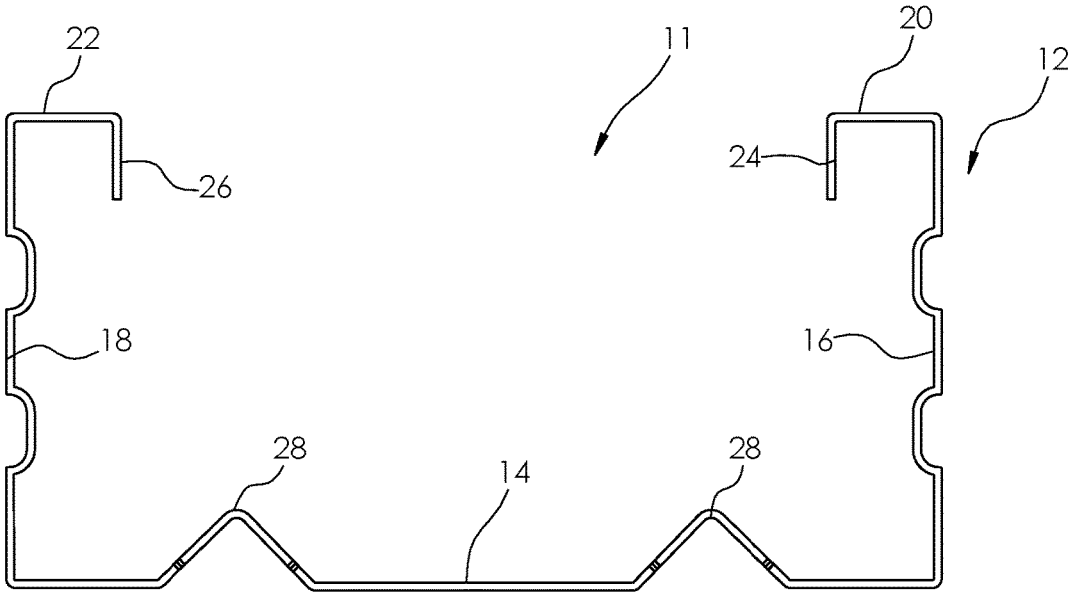
FIG. 8 is a top plan view of the frame member shown in FIG. 7.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

The non-limiting exemplary embodiment(s) is/are referred to generally in FIGS. 1-34A and is/are intended to provide a support wall frame system 10 for providing increased shear strength thereby preventing twisting and racking of a support wall constructed with system 10. The support wall frame system 10 includes at least one end track 34, 34*a* and a frame member 11 received within the at least one end track 34, 34*a*. Such a frame member 11 has a centrally registered longitudinal axis 68 and includes at least one rib 30, 32 extended parallel to the centrally registered longitudinal axis 68. Advantageously, the at least one rib 30, 32 is statically affixed to the at least one end track 34, 34*a*. Such a structural configuration provides the new, useful, and unexpected result of increasing the shear strength so that the frame member 11 resists twisting thereby preventing racking of the support wall 60 located between the end tracks 34, 34*a*.

In a non-limiting exemplary embodiment, the at least one rib 30, 32 includes an inwardly directed first rib 30 located along an entire first length 65 of the first stud side wall 16. An inwardly directed second rib 32 is located along an entire second length 66 of the second stud side wall 18. A stud base 14 is intercalated between the first stud side wall 16 and the second stud side wall 18, wherein opposed ends of stud base 14 are directly connected to the first stud side wall 16 and the second stud side wall 18. Advantageously, stud base 14 is adapted to be received within the at least one end track 34, 34*a* such that a latitudinal width 69 of stud 12 is disposed between the first track side wall 38 and the second track side wall 40 and such that the first detent 42 is received within the first rib 30 and the second detent 44 is received within the second rib 32. Such a structural configuration provides the new, useful, and unexpected result of increasing the shear strength so that the frame member 11 resists twisting thereby preventing racking of the support wall 60 located between the end tracks 34, 34*a*.

In a non-limiting exemplary embodiment, the at least one end track 34, 34*a* has a centrally registered longitudinal axis 67 and includes a bottom end track 34 and a top end track 34*a*, each including a track base 36 having a first track side wall 38 extending upwardly from a first longitudinal edge 36*a* of the track base 36 and a second track side wall 40 extending upwardly from a second longitudinal edge 36*b* of the track base 36. Notably, the first track side wall 38 has an inwardly directed first detent 42 and the second track side wall 40 has an inwardly directed second detent 44. Advantageously, each of the first detent 42 and the second detent 44 is extended along an associated major longitudinal height 71 of the first track side wall 38 and the second track side wall 40, respectively.

In a non-limiting exemplary embodiment, the at least one end track 34, 34*a* further includes an inwardly directed third detent 46 extended along a major latitudinal width 69 of the track base 36. Advantageously, the inwardly directed third detent 46 is registered orthogonal to the inwardly directed first detent 42 and the inwardly directed second detent 44.

In a non-limiting exemplary embodiment, the frame member 11 further includes at least one inwardly directly stiffener 28 juxtaposed along a longitudinal length of the stud base 14. In this manner, the axially opposed ends of at least one inwardly directed stiffener 28 is directly abutted against the at least one end track 34, 34*a*. It is noted that the stiffeners 28 are not mandatory. Moreover, the broken edges 90 at stiffeners 28 are intended to mean that the frame member 11 longitudinally extends beyond the portion shown in the FIGS. 1-18. See FIGS. 19-20 for an illustration of how long the frame members 11 longitudinally extend relative to the end tracks 34, 34*a*.

In a non-limiting exemplary embodiment, a support wall frame system 10 for providing increased shear strength thereby preventing twisting and racking of a support wall 60 is disclosed. Such a support wall frame system 10 includes at least one end track 34, 34*a* having a first centrally registered longitudinal axis 67 and a plurality of planar side walls 36, 38, 40 contiguously configured to have a substantially U-shaped cross-section. The at least one end track 34, 34*a* includes at least one linear detent 42, 44, 46 extended along a major height/width (distances 71, 69) of the at least one of the planar side walls 36, 38, 40. Notably, a frame member 11 is received within the at least one end track 34, 34*a*, and is intercalated therebetween. Such a frame member 11 includes a stud 12 and has a second centrally registered longitudinal axis 68. The frame member 11 (stud 12) includes at least one rib 30, 32 extended parallel to the entire second centrally registered longitudinal axis 68. Advantageously, the at least one rib 30, 32 is statically interfitted with the at least one detent 42, 44, 46 and extended along the associated major height/width (distances 71, 69) of the at least one of the planar side walls 36, 38, 40. Such a structural configuration provides the new, useful, and unexpected result of increasing the shear strength so that the frame member 11 resists twisting thereby preventing racking of the support wall 60 located between the end tracks 34, 34*a*.

In a non-limiting exemplary embodiment, the at least one end track 34, 34*a* includes a track base 36, a first longitudinal wall 38, and a second longitudinal wall 40 extending vertically upward from the track base 36. Each of the first longitudinal wall 38 and the second longitudinal wall 40 has a top edge 87 and a bottom edge 88 opposed therefrom. A shoulder is formed at a bend of track base 36 and longitudinal walls 38, 40. Advantageously, the at least one detent 42, 44, 46 is contiguously positioned (engaged) with the top edge 87 and spaced from the bottom edge 88. (Please note these edges 87, 88 are inverted depending on the orientation of track 34, 34*a*). Such a structural configuration provides the new, useful, and unexpected result of increasing the shear strength so that the frame member 11 resists twisting thereby preventing racking of the support wall 60 located between the end tracks 34, 34*a*. It also permits the track 34, 34*a* to be bent into a substantially U-shaped cross-section from a single and unitary sheet of metal, which significantly reduces manufacturing costs, time, and labor. Notably a gap remains between axially opposed ends of the detents 42, 44, 46 and the shoulders of the tracks 34, 34*a* so that the requisite tool can quickly form the detents in a cost-effective manner during a manufacturing process.

Referring to FIGS. 1-34A in general, in a non-limiting exemplary embodiment, the at least one end track 34 can be matched with the ribs 30, 32 for providing a predetermined layout configuration so the user knows which frame member 11 should be attached to each section of the at least one end track 34. This will simplify the framing installation process. Use of the ribs 30, 32 increases the axial load capacity. Such ribs 30, 32 are specially designed to accommodate fasteners to fit flush metal to metal without undesirable separation.

In a non-limiting exemplary embodiment, the frame member 11 may also have the fold down knockout for bracing while permitting electrical and plumbing components to pass therethrough. As perhaps best shown in FIGS. 10 and 15-15A, a bottom end track 34 and top end track 34*a* preferably have matching detents 42, 44 to interlock the stud 12 at ribs 30, 32. By having a plurality of ribs 30, 32 seated at opposed top and bottom ends of stud 12, the stud 12 is prohibited from undesirably rotating or twisting once fastened in place to end tracks 34, 34*a*. Such a structural configuration provides two or more connections at the top and bottom ends of stud 12, thereby adding to pull out and shear resistance forces. The unexpected and unpredictable result provides an anti-racking support wall frame system 10 that keeps the support wall 60 square, without requiring heavier gauge studs to be employed.

In a non-limiting exemplary embodiment, the present disclosure overcomes the need to provide reinforcement straps while providing higher shear resistance values. However, if desired, the reinforcement straps may be employed if desired.

In a non-limiting exemplary embodiment, as perhaps best shown in FIGS. 10 and 13-15A, the metal support wall frame system 10 includes at least one end track (e.g., bottom end 34 and top end track 34*a*), and a frame member 11 received within the at least one end track 34. The frame member 11 includes a plurality of ribs 30, 32 and a plurality of stiffeners 28 spaced therefrom, respectively. The plurality of ribs 30, 32 are statically affixed to the at least one end track 34, and the plurality of stiffeners 28 are abutted against the at least one end track 34. For example, as perhaps best shown in FIGS. 14 and 14*a*, stiffeners 28 engage and extend between a bottom end track 34 and a top end track 34*a*.

In a non-limiting exemplary embodiment, the frame member 11 has a single and unitary metal body.

With reference to FIGS. 1-34A in general, in a non-limiting exemplary embodiment, frame member 11 includes a stud 12 that has stud base 14 that has a first stud side wall 16 extending upwardly from one end of the stud base 14 and a second stud side wall 18 extending upwardly from an opposing end of the stud base 14, the two side walls 16 and 18 being coextensive and parallel with one another and being perpendicularly oriented with respect to the stud base 14. A first return leg 20 extends inwardly from the distal end of the first stud side wall 16 while a second return leg 22 extends inwardly from the distal end of the second stud side wall 18. The first return leg 20 and the second return leg 22 are each substantially similar in length are perpendicularly oriented with respect to their respective side wall 16 and 18, and are substantially parallel with the stud base 14.

In a non-limiting exemplary embodiment, an optional first flange 24 extends downwardly from the end of the first return leg 20 while an optional second flange 26 extends downwardly from the end of the second return leg 22. The first flange 24 and the second flange 26 are each substantially similar in length are perpendicularly oriented with respect to their respective return leg 20 and 22, and are substantially parallel with the first stud side wall 16 and the second stud side wall 18.

In a non-limiting exemplary embodiment, a pair of stiffeners 28 is located along the stud base 14 in spaced apart fashion, each stiffener being a generally V-shaped member that protrudes inwardly into the metal frame member 10 toward the first return leg 20 and the second return leg 22. Although two stiffeners 28 are illustrated, the use of a single stiffener or more than two stiffeners is also possible.

In a non-limiting exemplary embodiment, a first pair of inwardly directed, generally U-shaped ribs 30 is located along the first stud side wall 16 while a second pair of inwardly directed, generally U-shaped ribs 32 is located along the second stud side wall 18.

In a non-limiting exemplary embodiment, the metal frame member 10 is substantially symmetrical about a vertical axis that passes in perpendicular fashion, through the midpoint of the stud base 14.

Figure 9:
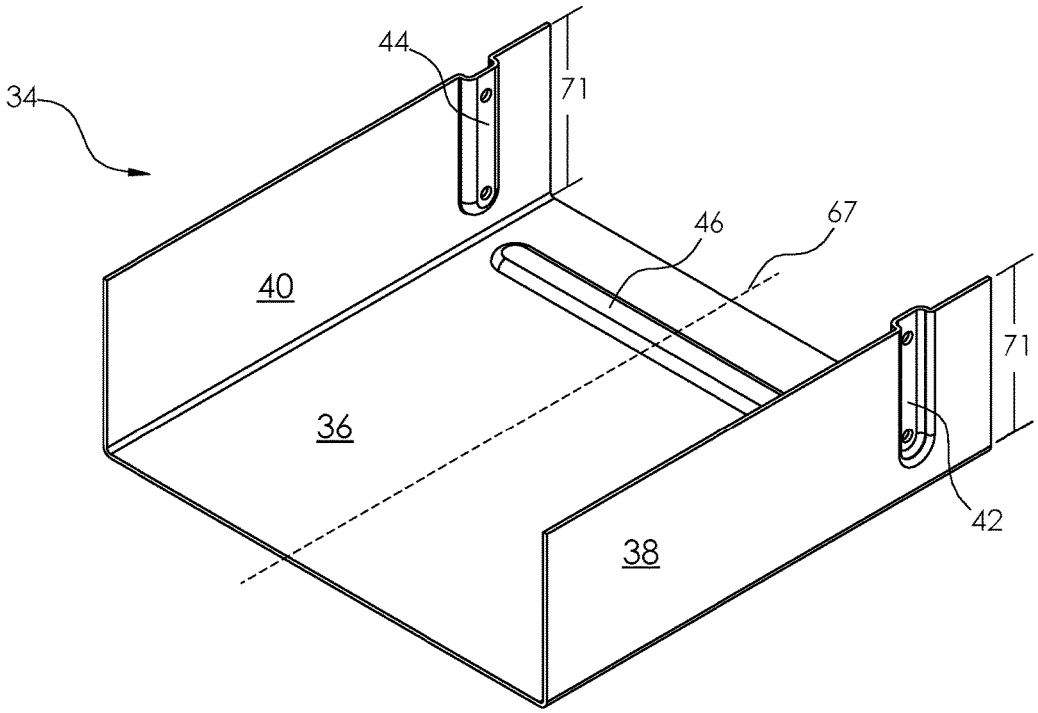
FIG. 9 is a perspective view of at least one end track wherein the detents are juxtaposed from conjoining shoulders (junctures) of the track's side walls, in accordance with a non-limiting exemplary embodiment of the present disclosure.
Figure 10:
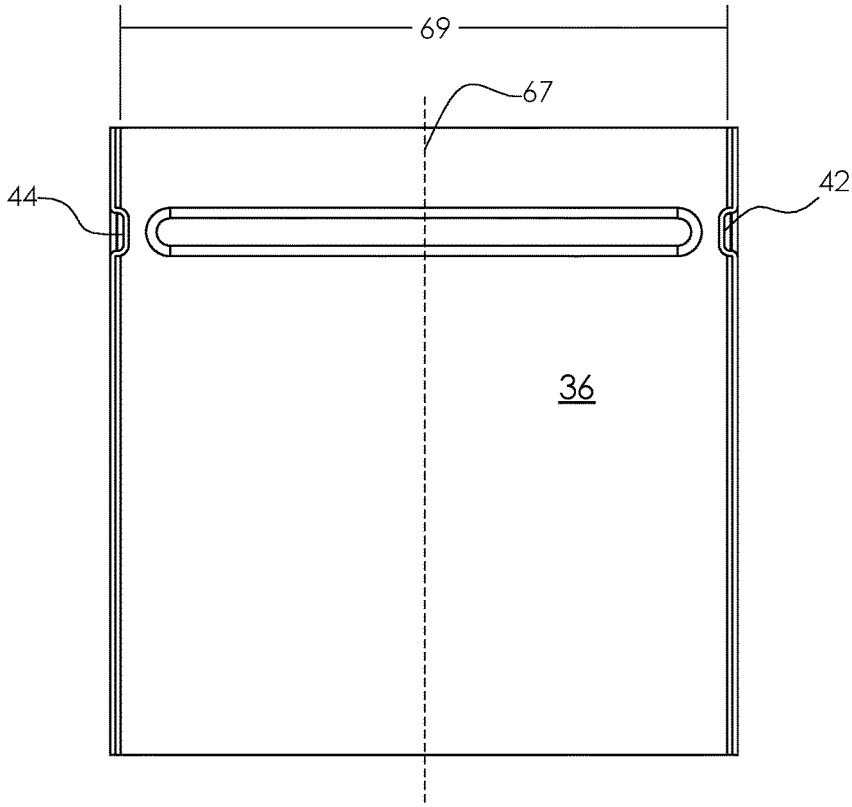
FIG. 10 is a bottom plan view of the at least one track shown in FIG. 9.
Figure 11:
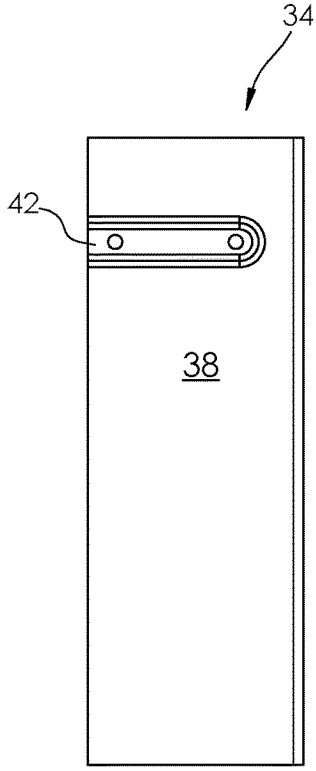
FIG. 11 is a side elevational view of the at least one track shown in FIG. 11.
Figure 12:
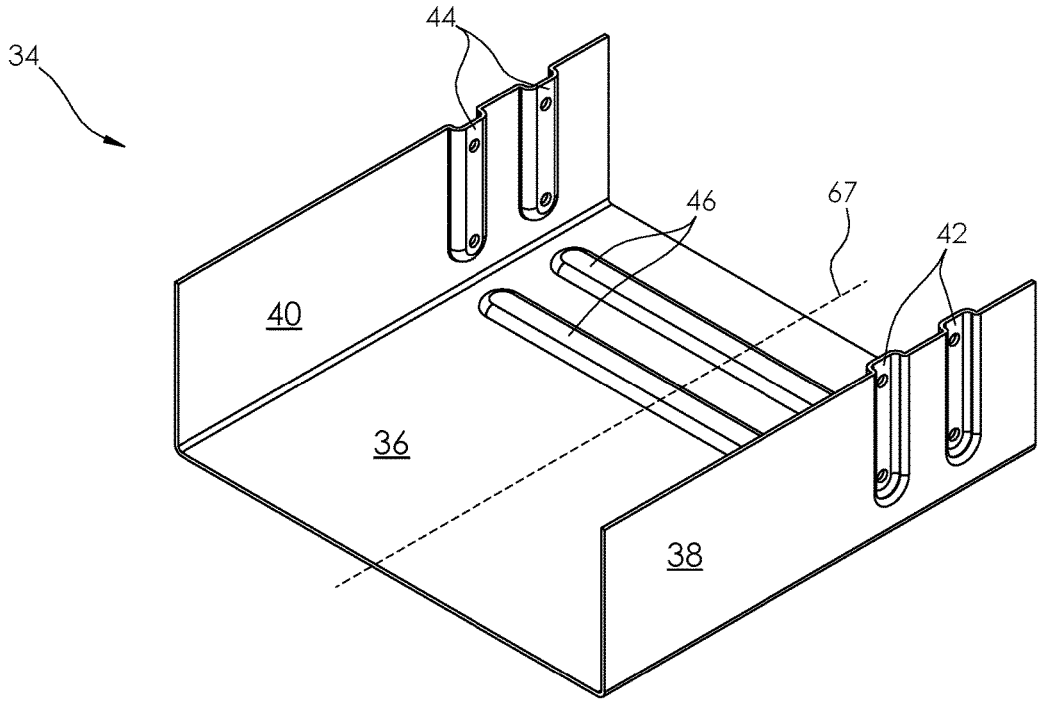
FIG. 12 is a perspective view of at least one end track wherein the detents are juxtaposed from conjoining shoulders (junctures) of the track's side walls, in accordance with another non-limiting exemplary embodiment of the present disclosure.
Figure 13:
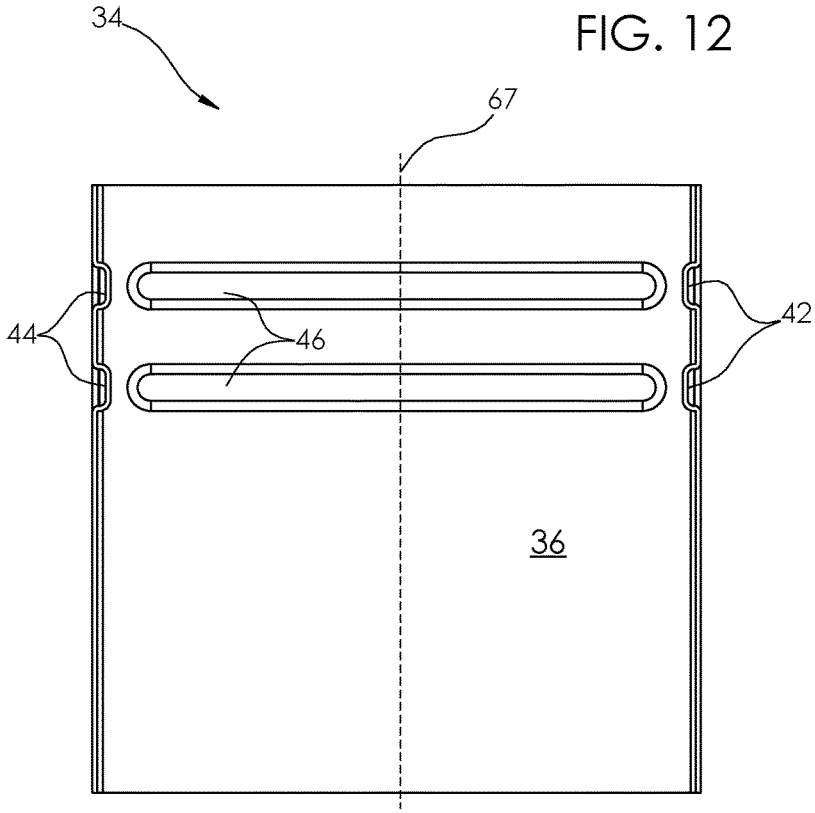
FIG. 13 is a bottom plan view of the at least one track shown in FIG. 9.
Figure 14:
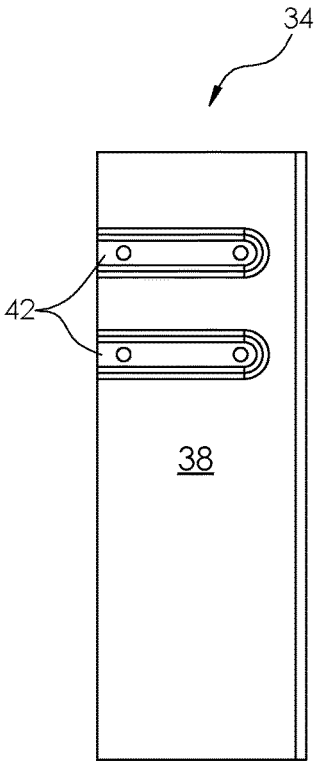
FIG. 14 is a side elevational view of the at least one track shown in FIG. 11.
Figure 15:
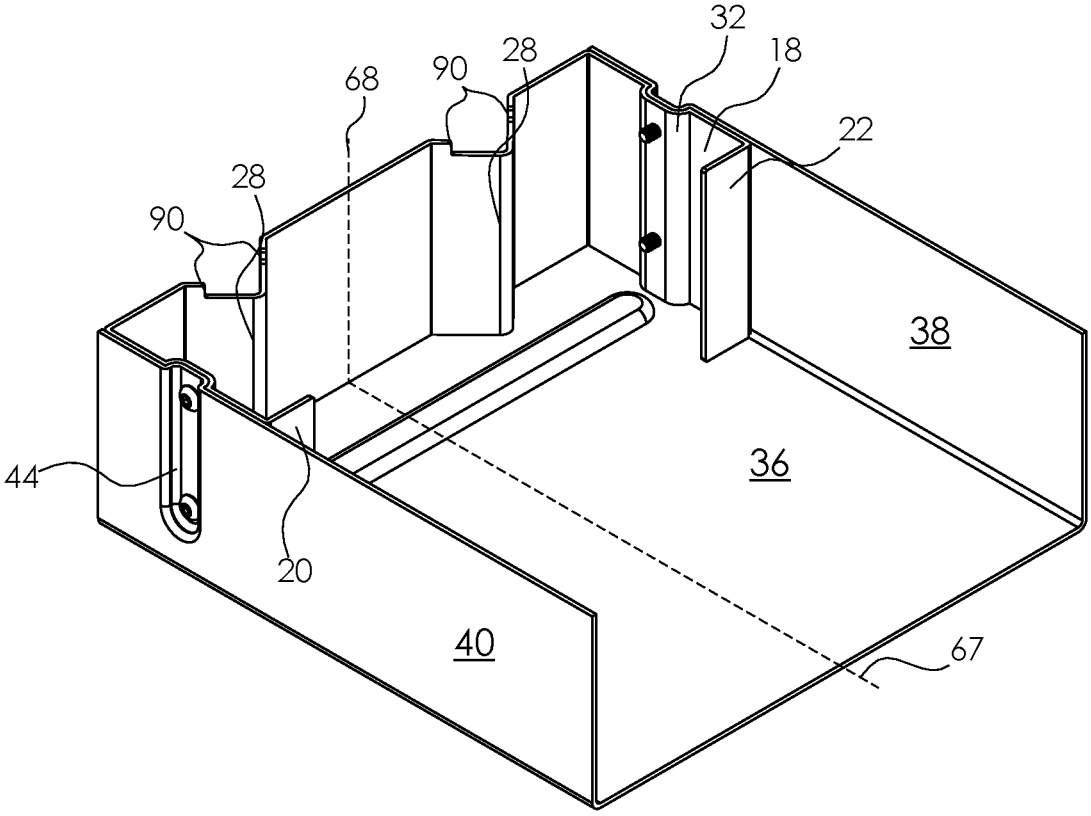
FIG. 15 is a perspective view showing a frame member seated at an associated track wherein the ribs are interfitted flush with the detents, in accordance with a non-limiting exemplary embodiment of the present disclosure.
Figure 16:
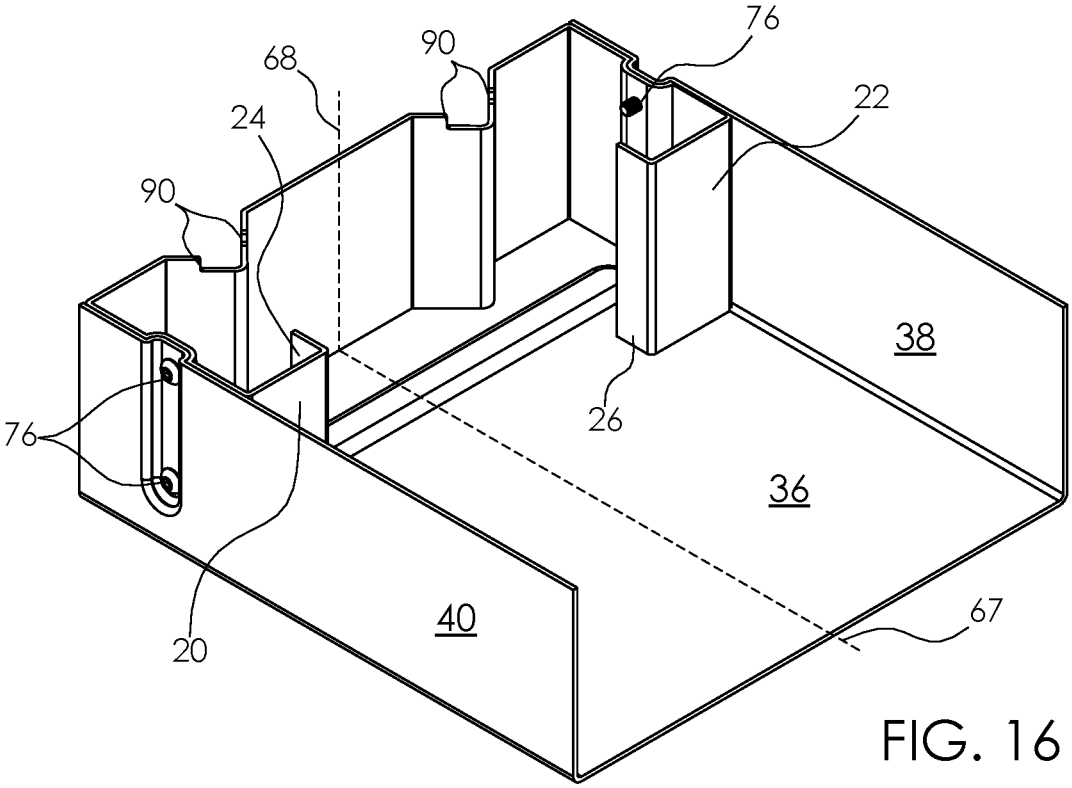
FIG. 16 is a perspective view showing a frame member seated at an associated track wherein the ribs are interfitted flush with the detents, in accordance with another non-limiting exemplary embodiment of the present disclosure.
Figure 17:
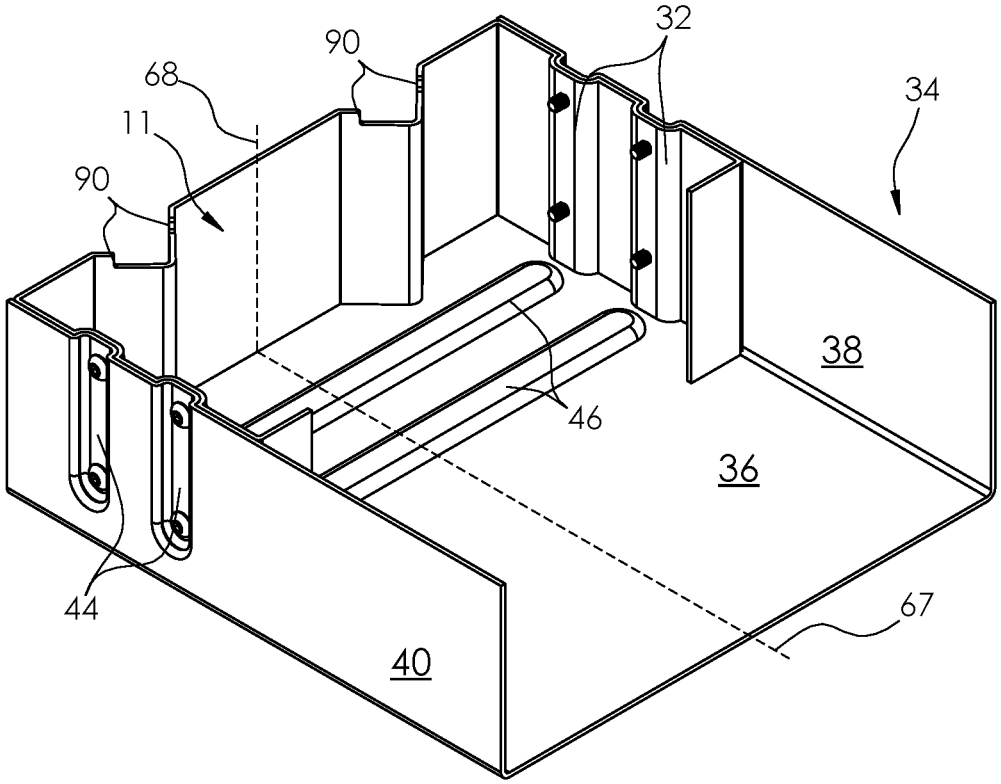
FIG. 17 is a perspective view showing a frame member seated at an associated track wherein the ribs are interfitted flush with the detents, in accordance with yet another non-limiting exemplary embodiment of the present disclosure.
Figure 18:
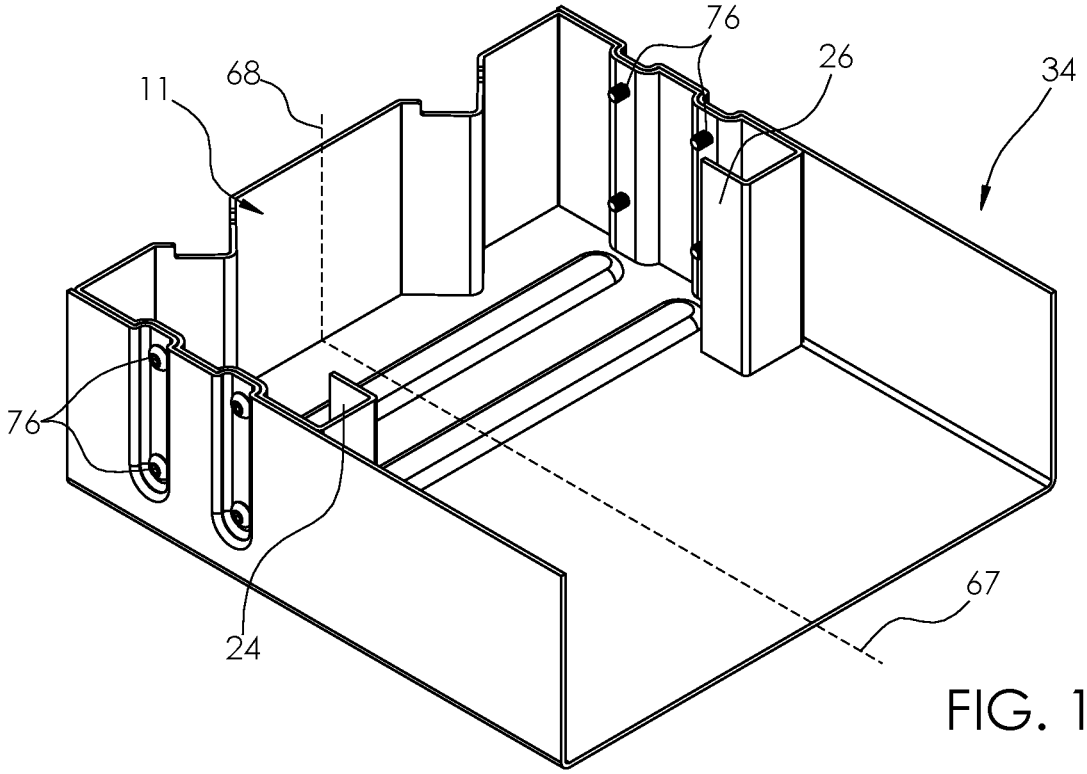
FIG. 18 is a perspective view showing a frame member seated at an associated track wherein the ribs are interfitted flush with the detents, in accordance with yet another non-limiting exemplary embodiment of the present disclosure.
Figure 19:
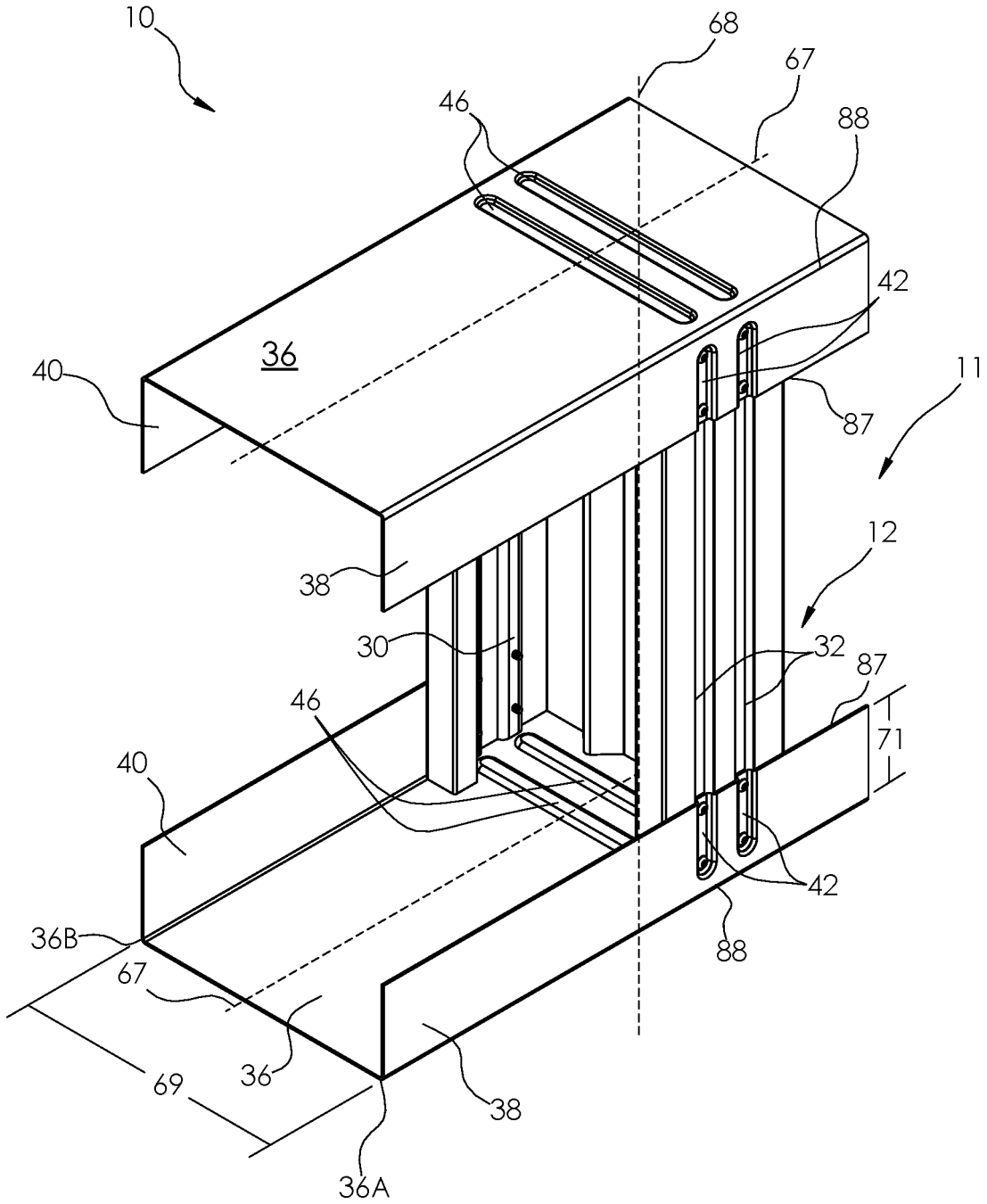
FIG. 19 is a perspective view showing a pair of frame members intercalated between a plurality of associated tracks.
Figure 20:
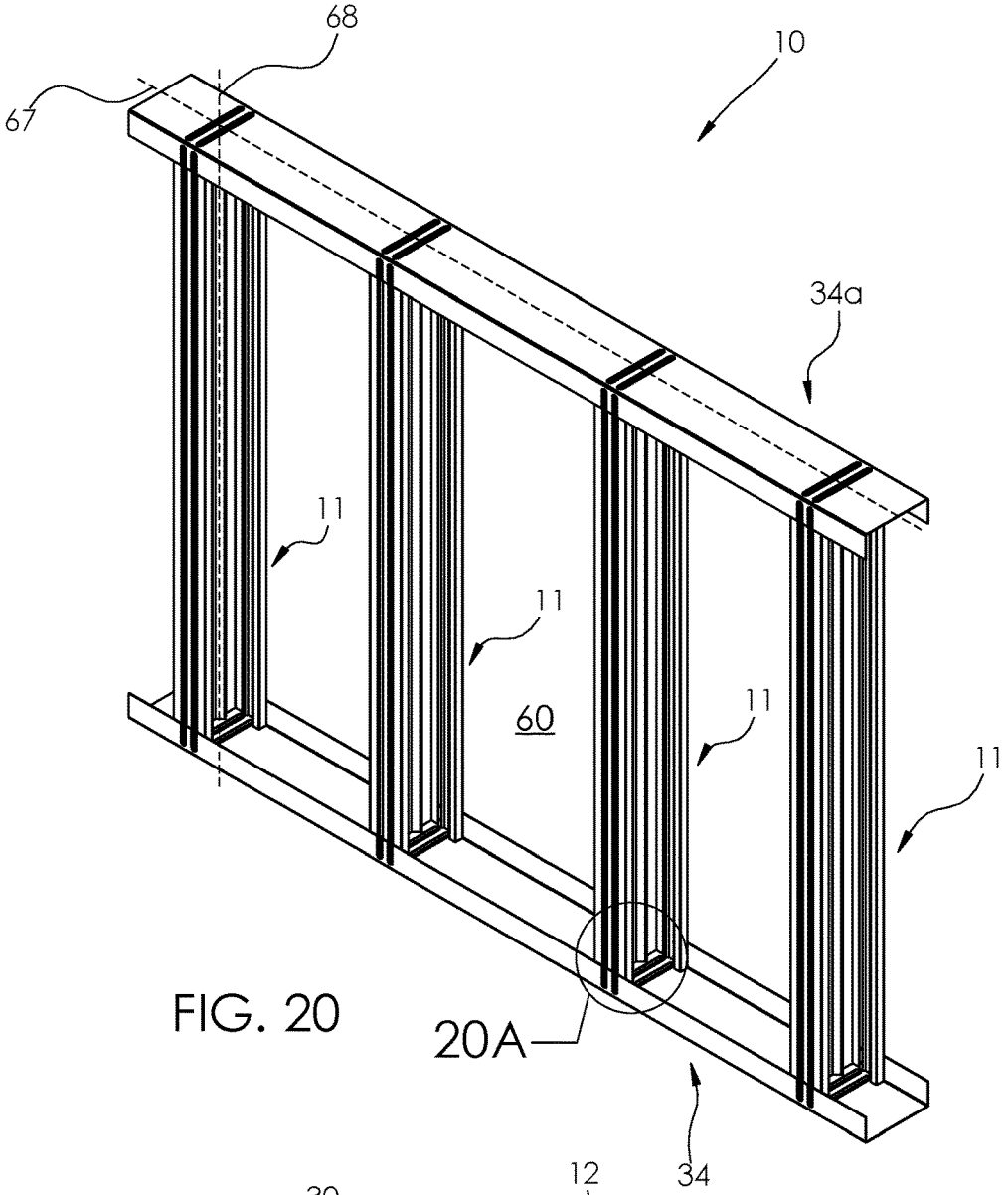
FIG. 20 is a perspective view showing a pair of frame members intercalated between a plurality of associated tracks in an exemplary environment for reinforcing a support wall of a building structure.
Figure 20A:
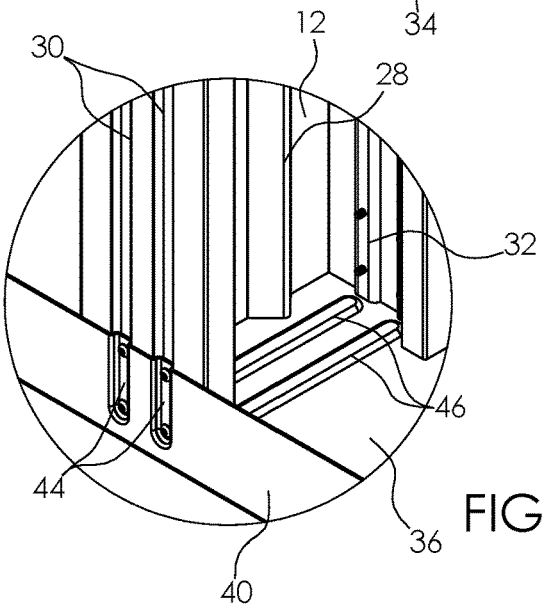
FIG. 20A is an enlarged view of section 20A taken in FIG. 20.
Figure 21:
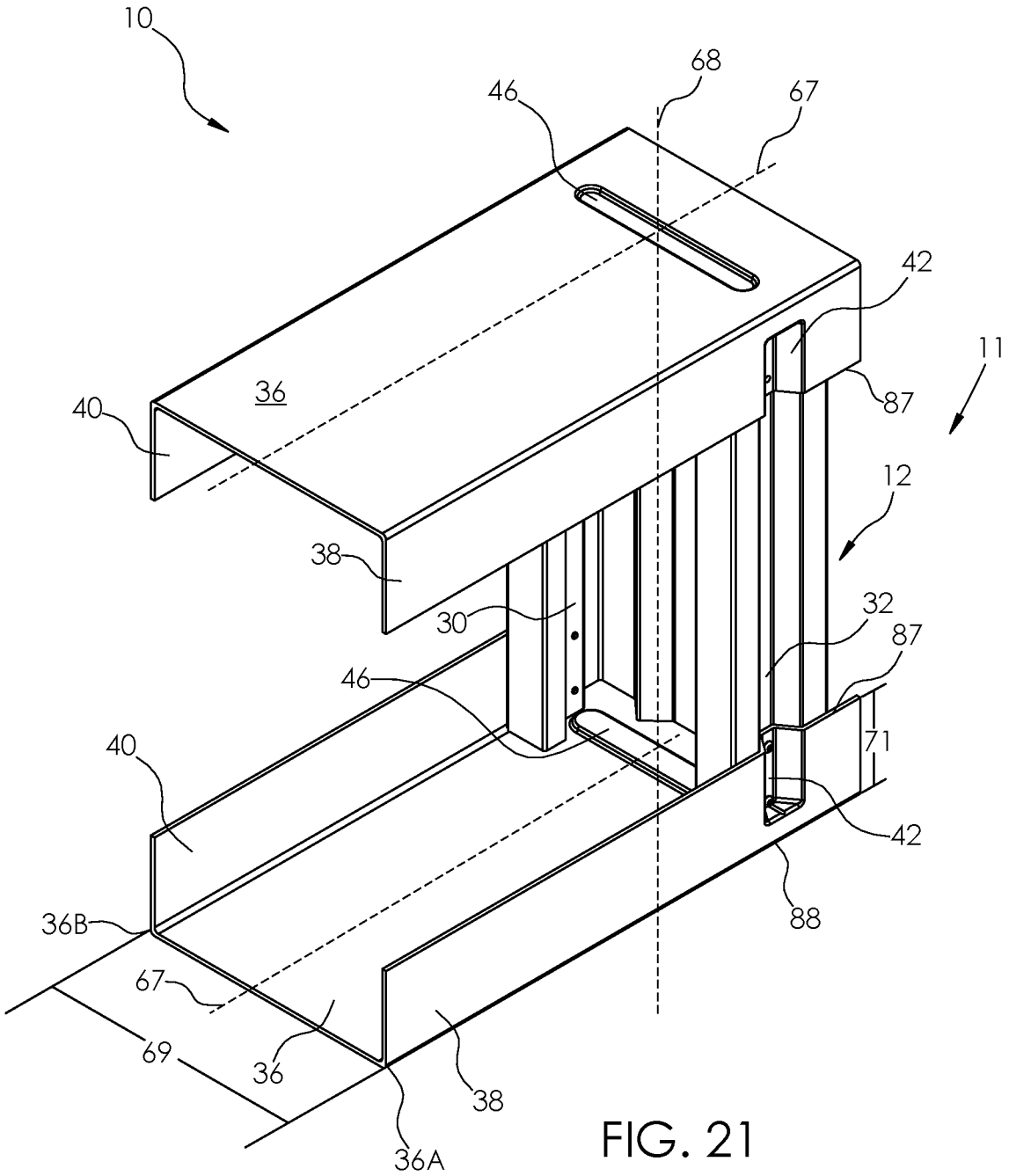
FIG. 21 is a perspective view showing a single frame member having a single rib and being intercalated between a plurality of associated tracks, in another exemplary environment for reinforcing a support wall of a building structure.
Figure 22:
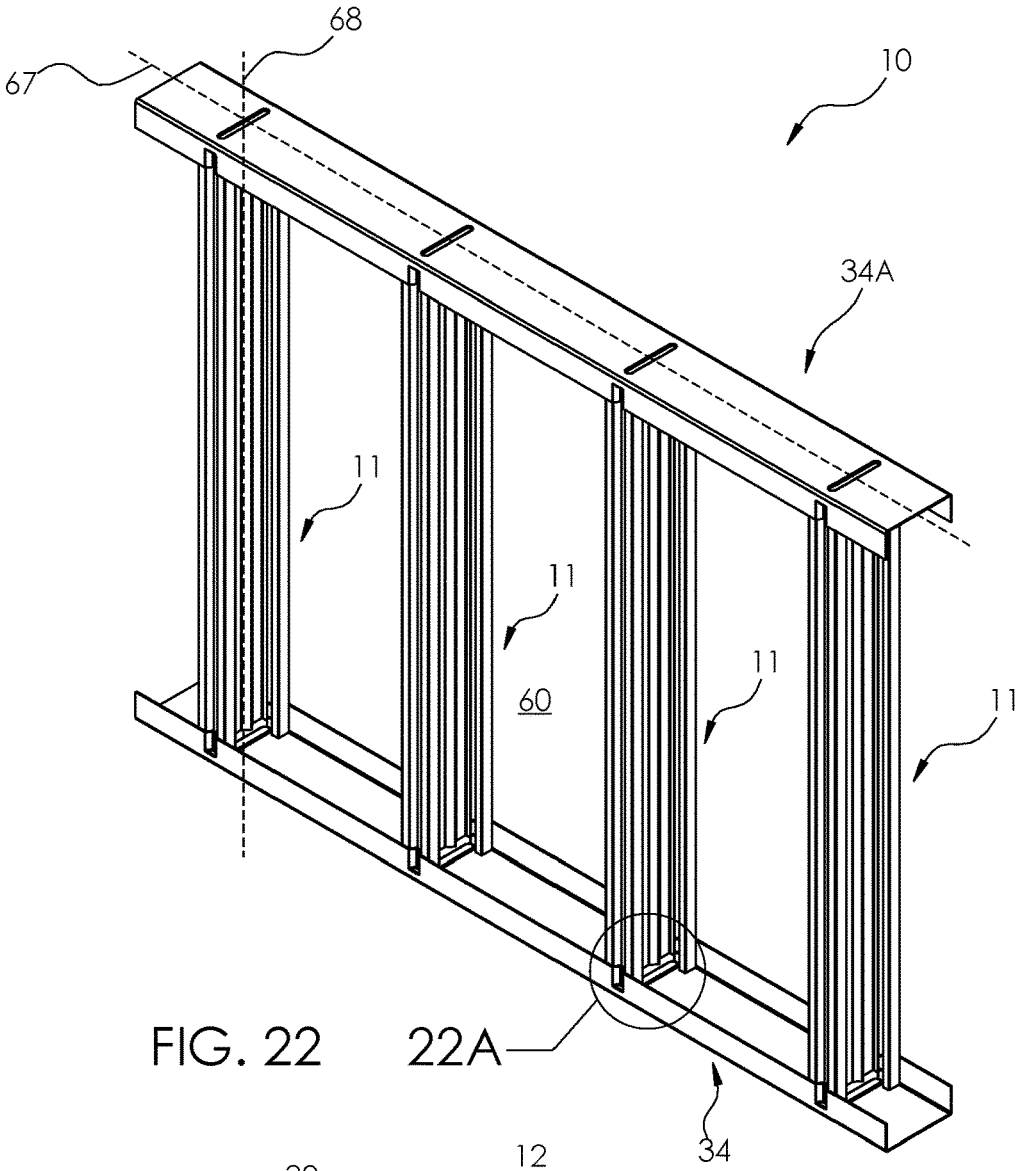
FIG. 22 is a perspective view showing a plurality of frame members each having a single rib and being intercalated between a plurality of associated tracks, in another exemplary environment for reinforcing a support wall of a building structure.
Figure 22A:
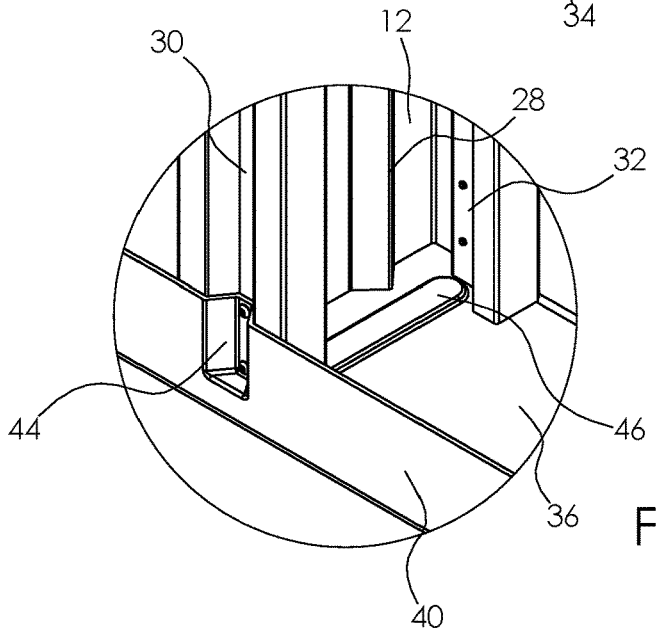
FIG. 22A is an enlarged view of section 22A taken in FIG. 22.
Figure 23:
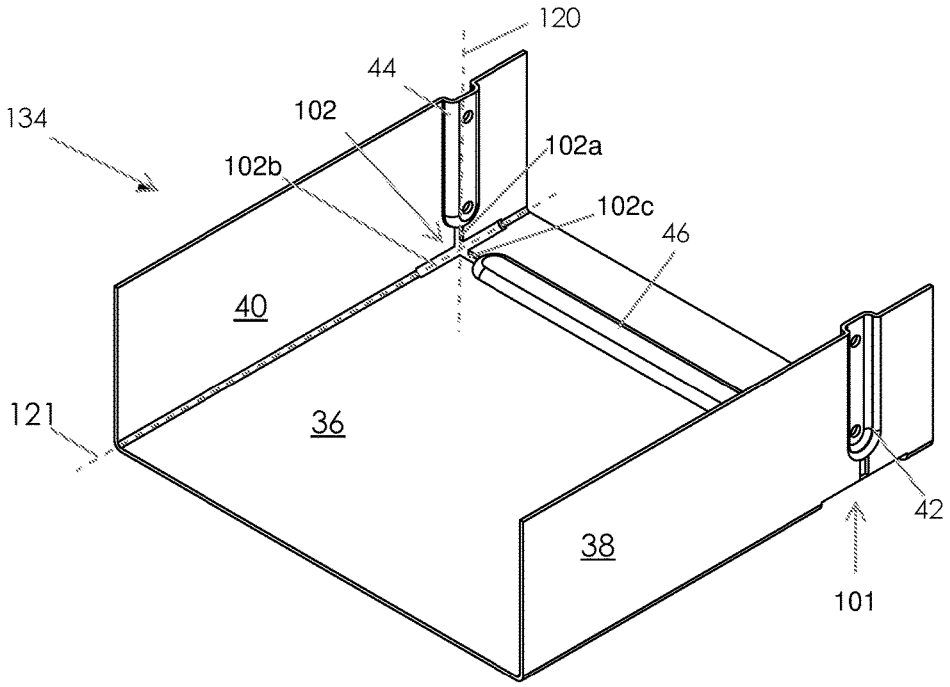
FIG. 23 is a perspective view of at least one end track wherein the first and second openings are located at shoulders (junctures) of the track side walls and track base, in accordance with a non-limiting exemplary embodiment of the present disclosure.
Figure 24:
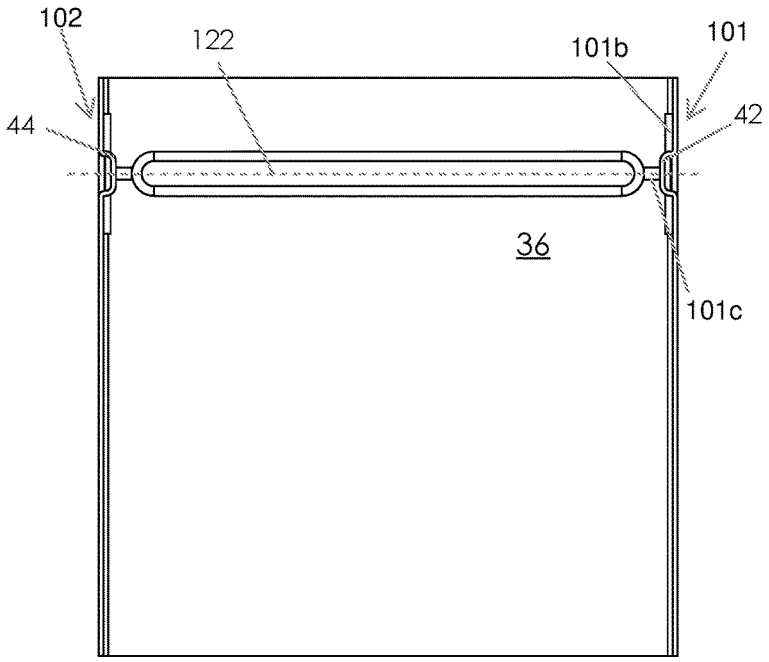
FIG. 24 is a bottom plan view of the at least one track shown in FIG. 23.
Figure 25:
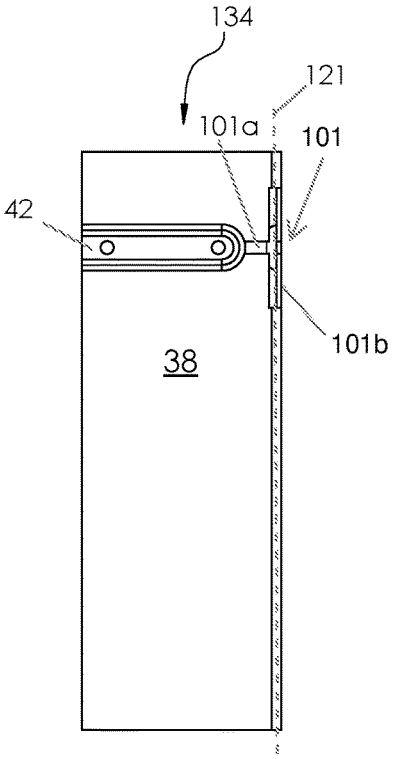
FIG. 25 is a side elevational view of the at least one track shown in FIG. 23.
Figure 26:
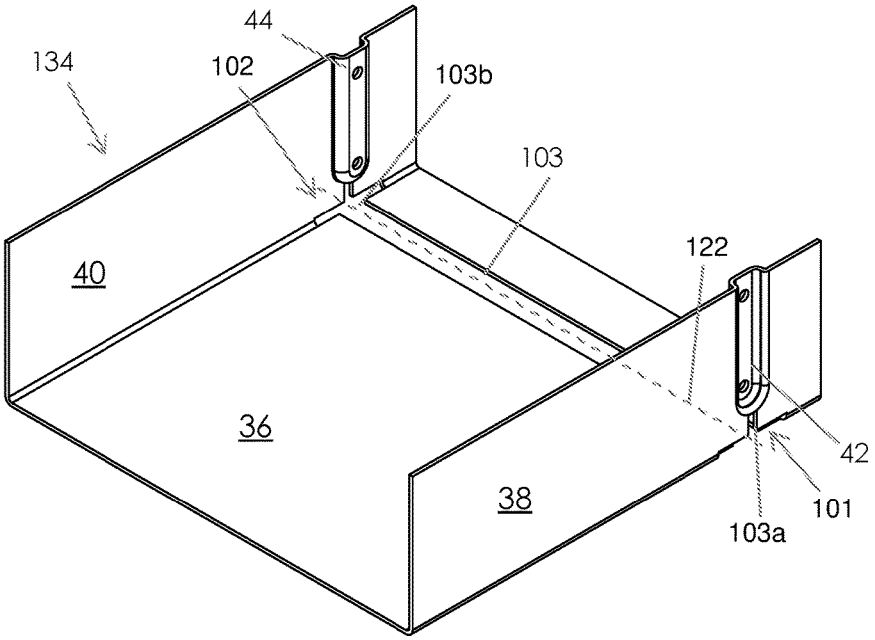
FIG. 26 is a perspective view of at least one end track wherein the first, second, and third openings are illustrated, in accordance with a non-limiting exemplary embodiment of the present disclosure.
Figure 27:
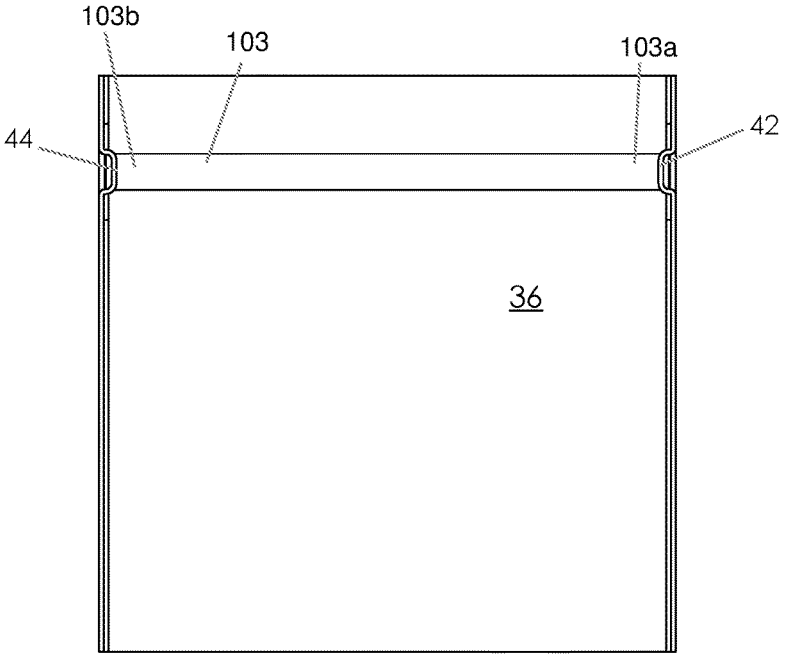
FIG. 27 is a bottom plan view of the at least one track shown in FIG. 26.
Figure 28:
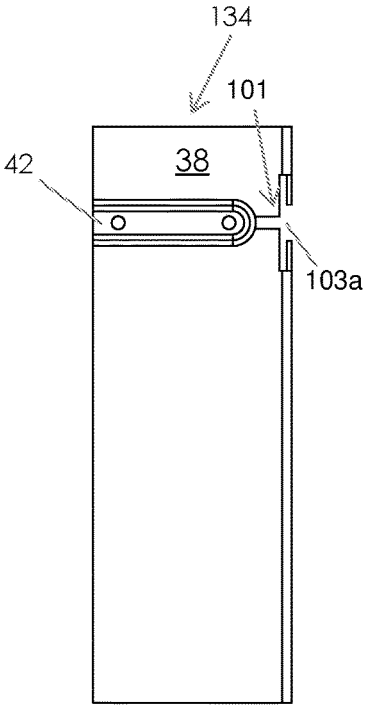
FIG. 28 is a side elevational view of the at least one track shown in FIG. 26.
Figure 29:
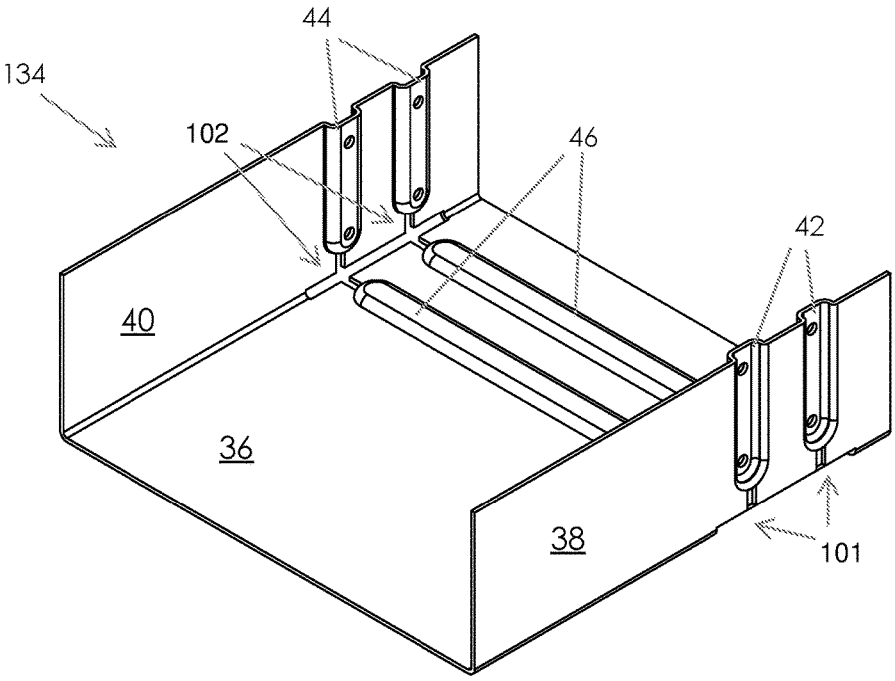
FIG. 29 is a perspective view of at least one end track wherein first and second pairs of openings are located at shoulders (junctures) of the track side walls and track base, in accordance with a non-limiting exemplary embodiment of the present disclosure.
Figure 30:
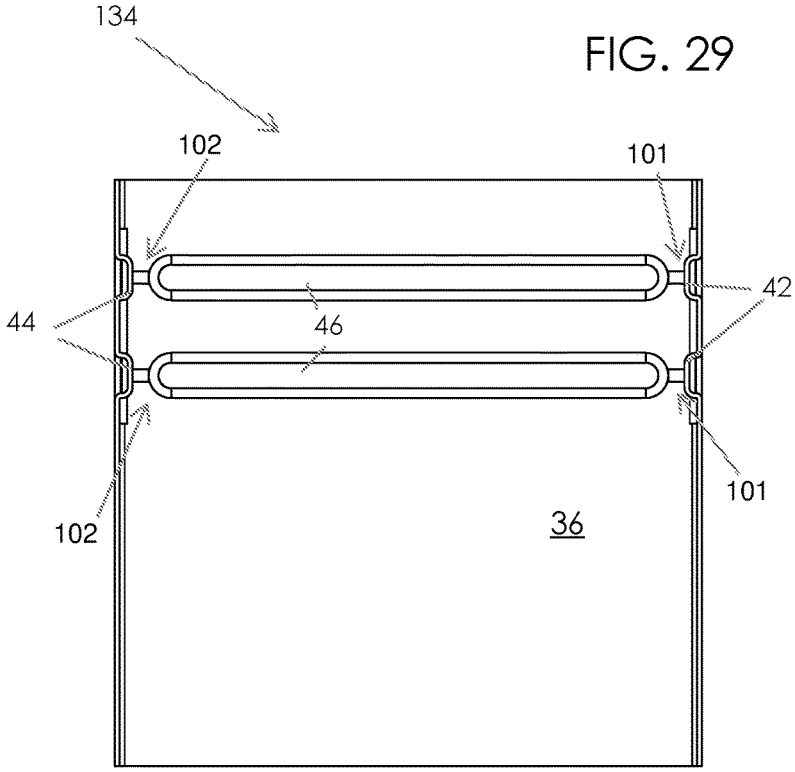
FIG. 30 is a bottom plan view of the at least one track shown in FIG. 29.
Figure 31:
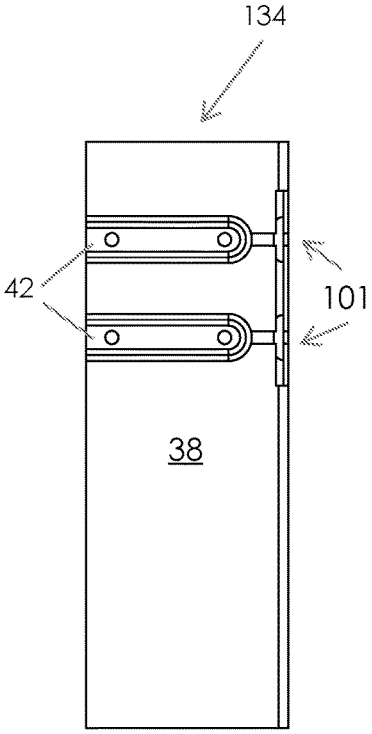
FIG. 31 is a side elevational view of the at least one track shown in FIG. 29.
Figure 32:
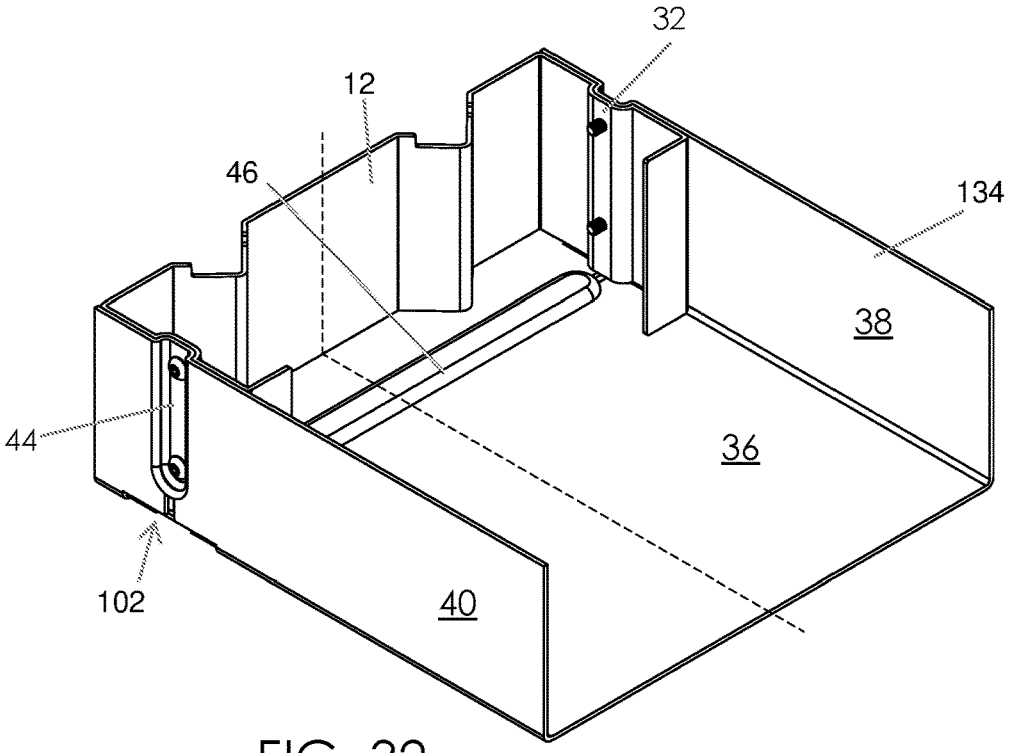
FIG. 32 is a perspective view showing a frame member seated at an associated track, having first and second openings, wherein the ribs are interfitted flush with the detents, in accordance with another non-limiting exemplary embodiment of the present disclosure.
Figure 33:
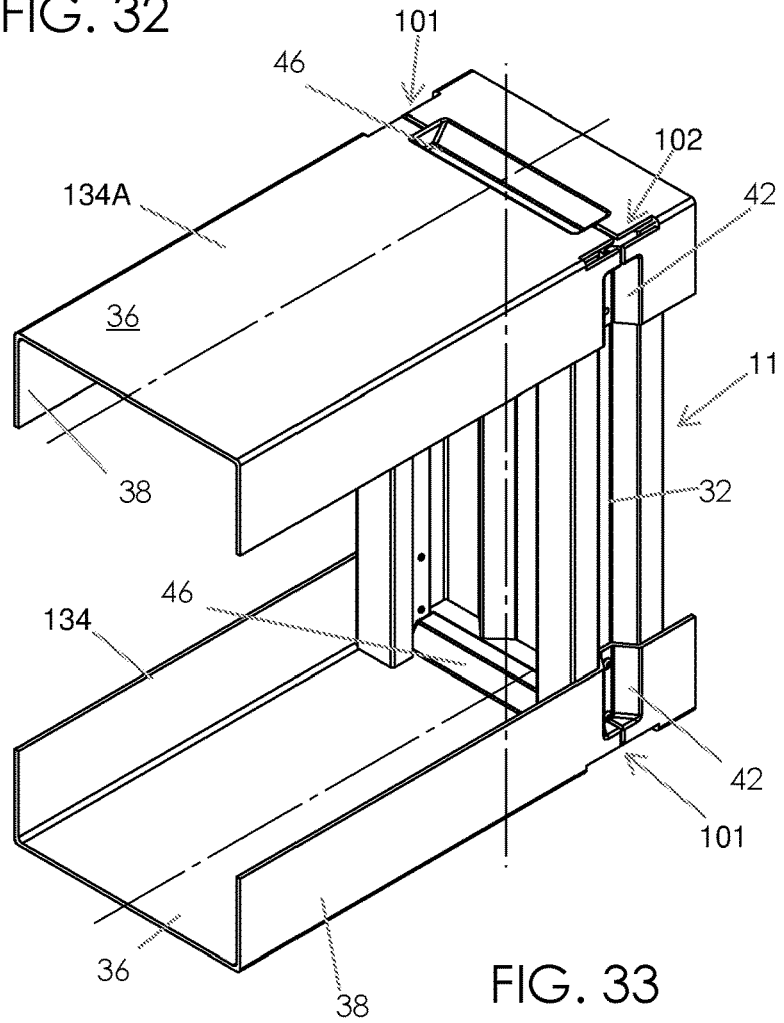
FIG. 33 is a perspective view showing a single frame member having a single rib and being intercalated between a plurality of associated tracks, each having first and second openings, in another exemplary environment for reinforcing a support wall of a building structure.
Figure 34:
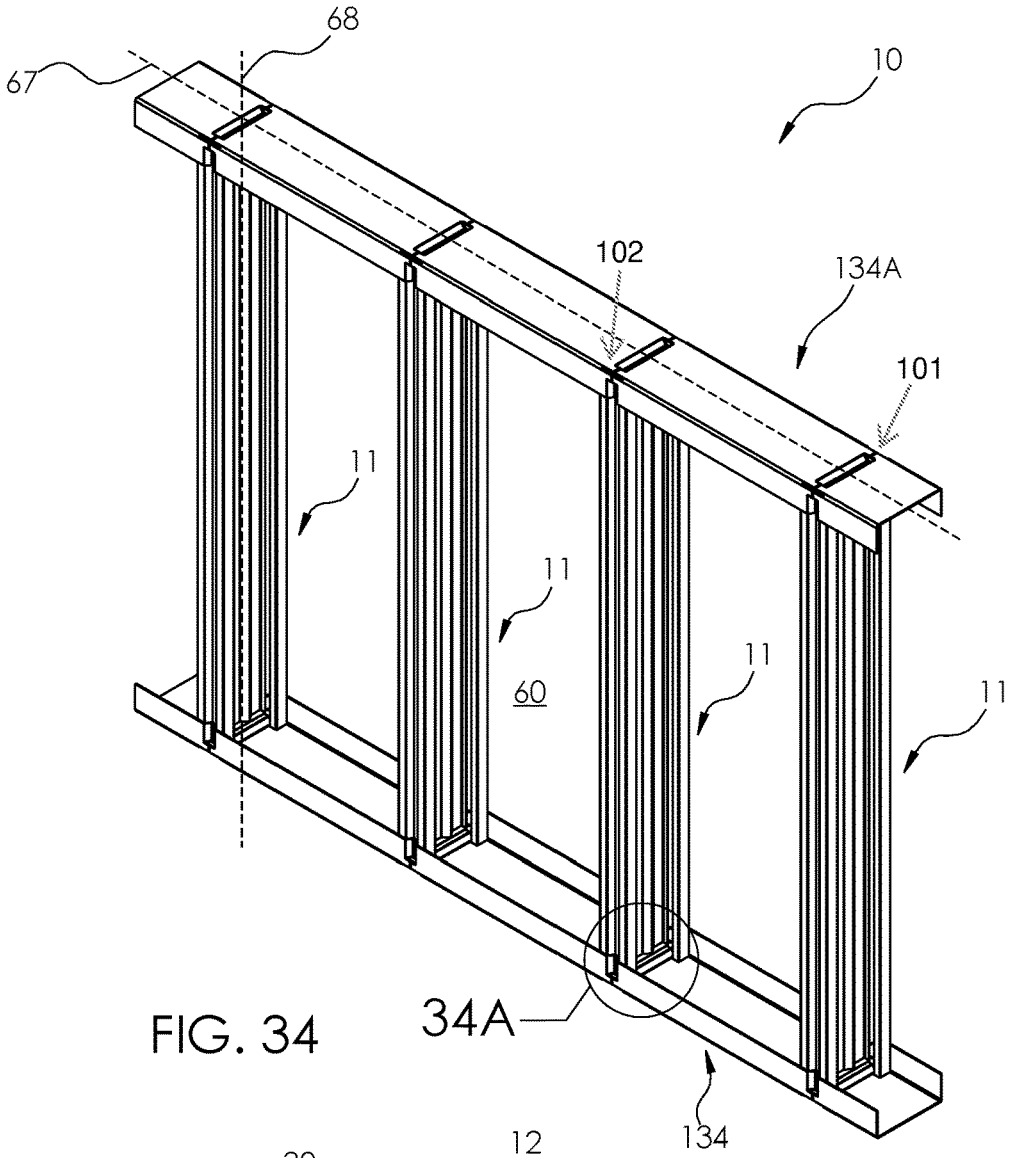
FIG. 34 is a perspective view showing a plurality of frame members each having a single rib and being intercalated between a plurality of associated tracks, each having first and second openings, in another exemplary environment for reinforcing a support wall of a building structure.
Figure 34A:
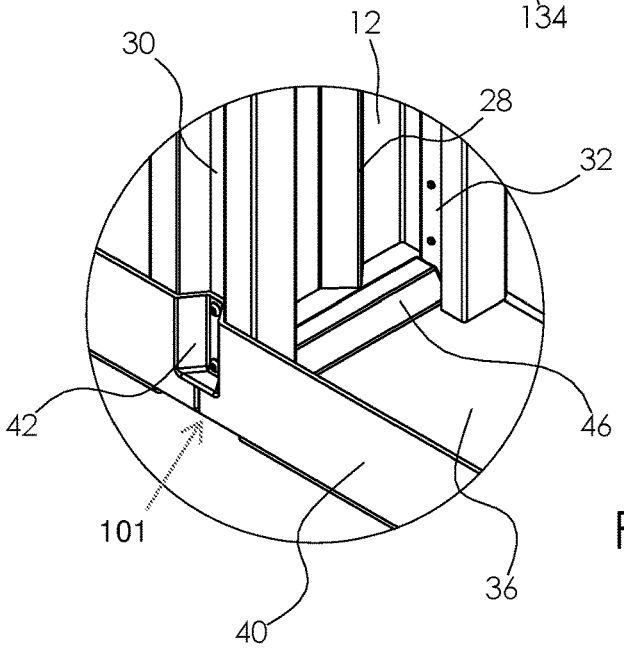
FIG. 34A is an enlarged view of section 34A taken in FIG. 34.

Advantageously, the entire metal frame member 10 is formed from a single, integral, and continuous sheet of metal, such aluminum, steel, and the like, and is formed into the particular geometry using an appropriate manufacturing technique (stamping, extrusion, roll forming, etc.,). The size of a particular metal frame member 10, including the length, width, depth and gauge of metal used is dependent on the job at hand is engineered accordingly. For example, FIG. 9 is a top plan view of a metal frame member 11 having ribs 30, 32 and stiffeners 28 spaced apart at alternate distances 77, 78 relative to the embodiment illustrated in FIG. 1, respectively, in accordance with a non-limiting exemplary embodiment of the present disclosure.

Ideally, each corner of the stud 12 is radiused to help prevent cutting injuries to workers handling the stud 12 while the end of each flange 24 and 26, if used, and if not, the end of each return leg 20 and 22 is appropriately finished, again to help prevent cutting injuries to workers handling the stud 12.

In a non-limiting exemplary embodiment, an end track 34 is provided. The end track 34 is a typical end track used in metal stick frame construction, modified to utilize the features of the stud 12. Specially, the end track 34 has a track base member 36 from which a first track side wall 38 and a second track side wall 40 each extend upwardly from either end of the base member 36 a small distance. The first track side wall 38 and a second track side wall 40 are each coextensive and parallel with one another are each oriented in perpendicular fashion relative to the track base 36. The distance between the inside surface of the first track side wall 38 and the inside surface of the second track side wall 40 is substantially similar to the distance between the outside surface of the first stud side wall 16 and the outside surface of the second stud side wall 18.

In a non-limiting exemplary embodiment, a series of first inwardly directed detent pairs 42 is located along the first track side wall 38 while a series of second inwardly directed detent pairs 44 is located along the second track side wall 40. Each first detent pair 42 is located directly across from a respective one of the second detent pairs 44. The spacing between each first detent pair 42, and thus the second detent pair 44, is based on the particular frame being built such as 18 inches spacing for 18 inches on center stud construction as is known in the art.

With reference to FIGS. 1-34A in general, in a non-limiting exemplary embodiment, the at least one end track 34 has additional juxtaposed detents 70 continuously extended along both side walls 38, 40 and base 36. Thus, each metal frame member 11 could include corresponding ribs 30, 32 and stiffeners 28 that interconnect within such detents 70 along both side walls 38, 40 and base 36 of the end track 34. It is noted that although such detents 70 are shown as having a generally single concave cross-section, the cross-section of such detents 70 can vary and will match the profile of the bottom and top ends of stud 12 so that they complement each other and provide a secure interconnection (e.g., corresponding tongue/groove or male/female configuration). Such detents 70 continuously extend across base 36 thereby providing additional balance and distribution of material without over stretching. Such a configuration increases the strength and maximum axial force without allowing the stud 12 to twist. Optionally, one or more detents 70 traveling across base 36 may be employed.

In order to install a stud 12 within the end track 34, an end of the stud 12 is placed into the end track 34 to that each first rib 30 receives a respective one of the first detents 42 of the end track 34 and each second rib 32 receives a respective one of the second detents 44 of the end track 34. As the width of the stud 12 (distance between outer surface of first longitudinal wall 16 and the outer surface of the second longitudinal wall 18) is substantially similar to the inside diameter (distance between the inner surface of the first track side wall 38 and the inner surface of the second track side wall 40), the stud 12 is generally friction held in place. The first detents 42 received within the first ribs 30 and the second detents 44 received within the second ribs 32 help lock the stud 12 in place within the end track 34.

Appropriate fasteners 76 are passed through each first rib-first detent pair and through each second rib-second detent pair to firmly attach the stud 12 to the end track 34. The fasteners 76 can be self-tapping or openings 48 can be pre-punched within each first rib 30 and each second rib as well as within each first detent 42 and each second detent 44. The rib-detent combination is dimensioned so that the installed fastener 46 is at best flush with the outer surface of the end track 34 (or countersunk as illustrated) for each of attaching appropriate sheathing to either side of the frame built. The detent-rib locking helps prevent stud 12 twisting within the end track 34, which tends to occur in conventional systems, especially after one side of the stud 12 is fastened to the end track 34. Each stud 12 is fastened to an end track 34 on either end of the stud 12.

Referring to FIGS. 23-34A, in a non-limiting exemplary embodiment, the support wall frame system 10 includes at least one end track 134, and a frame member 11 received within the at least one end track 134 and including an elongated stud 12 having a stud base 14 with a first stud side wall 16 and a second stud side wall 18. Such an elongated stud 12 includes a first rib 30 located along the first stud side wall 16 and a second rib 32 located along the second stud side wall 18. Stud base 14 is intercalated between the first rib 30 and the second rib 32. Advantageously, at least one end track 134 includes a bottom end track 134 and a top end track 134A spaced therefrom. Each of the bottom end track 134 and the top end track 134A includes a track base 36 having a first track side wall 38 and a second track side wall 40. Such a first track side wall 38 has an inwardly directed first detent 42 and the second track side wall 40 has an inwardly directed second detent 44. Each of the first detent 42 and the second detent 44 is extended along a major longitudinal height of the first track side wall 38 and the second track side wall 40, respectively. Optionally, a third detent 46 is located at track base 36. Advantageously, each of the bottom end track 134 and the top end track 134A includes a first opening 101 disposed along a first shoulder 109 of the track base 36 and the first track side wall 38, and a second opening 102 disposed along a second shoulder 110 of the track base 36 and the second track side wall 40. Advantageously, the first opening 101 and the second opening 102 each has a substantially cross-shape. Such a structural configuration yields the new, useful, and unexpected results of providing a first opening 101 and a second opening 102 for absorbing the shrinkage of track 134 material when the first, second, and third detents 42, 44, 46, respectively, are not continuous (touching) along the track 134. Thus, the first opening 101 and second opening 102 will vary depending on associated sizes of detents 42, 44, 46, respectively. If the detents 42, 44, 46 are on the top and bottom of track 134 then the expansion openings 101, 102 are only a small slit (about 90 degrees) at each shoulder of track 134. This solves the problem of undesirable crimping or creasing at the shoulders of track 134 when the detents 42, 44, 46 are created.

In a non-limiting exemplary embodiment, the first opening 101 is contiguous with the first detent 42, the first shoulder 109, and the third detent 46.

In a non-limiting exemplary embodiment, the first opening 101 includes a first rectilinear section 101*a* located entirely at the first track side wall 38 wherein the first rectilinear section 101*a* is directly abutted with the first detent 42 and is oriented parallel thereto along an x-axis 120, a first horizontal rectilinear section 101*b* located entirely along the first shoulder 109 wherein the first horizontal rectilinear section 101*b* is directly abutted with the first rectilinear section 101*a* and is oriented parallel to a y-axis 121, and a second rectilinear section 101*c* located entirely at the track base 36 wherein the second rectilinear section 101*c* is directly abutted with the third detent 46 and oriented perpendicular thereto along a z-axis 122.

In a non-limiting exemplary embodiment, the first rectilinear section 101*a* and the second rectilinear section 101*c* intersect a center of the first horizontal section 101*b*.

In a non-limiting exemplary embodiment, the second opening 102 is contiguous with the second detent 44, the second shoulder 110, and the third detent 46.

In a non-limiting exemplary embodiment, the second opening 102 includes a third rectilinear section 102*a* located entirely at the second track side wall 40 wherein the third rectilinear section 102*a* is directly abutted with the second detent 44 and oriented parallel thereto along an x-axis 120, a second horizontal rectilinear section 102*b* located entirely along the second shoulder 110 wherein the second horizontal rectilinear section 102*b* is directly abutted with the third rectilinear section 102*a* and oriented parallel to a y-axis 121, and a fourth rectilinear section 102*c* located entirely at the track base 36 wherein the fourth rectilinear section 102*c* is directly abutted with the third detent 46 and oriented perpendicular thereto along a z-axis 122.

In a non-limiting exemplary embodiment, the third rectilinear section 102*a* and the fourth rectilinear section 102*c* intersect a center of the second horizontal rectilinear section 102*b*.

In a non-limiting exemplary embodiment, each of the bottom end track 134 and the top end track 134A further includes a third opening 103 disposed along the track base 36. Advantageously, the third opening 103 has axially opposed ends 103*a*, 103*b* directly abutted to (continuous with) the first opening 101 and the second opening 102.

In a non-limiting exemplary embodiment, the third opening 103 is rectilinear and extends along an entire width of the track base 36, from the first shoulder 109 to the second shoulder 110.

Still referring to FIGS. 23-34A, in a non-limiting exemplary embodiment, track 134 includes a plurality of knocked-out or punched-out regions (e.g., openings 101-103) at the shoulders of track 134 and along track base 36. Such openings 101-103 can vary and can be horizontal or vertical depending on the shrinkage and gauge of the track 134 material when the detents 42, 44, 46 are rolled or embossed. Each detent 42, 44, 46 consumes a different width in knocked-out regions of track 134. Notably, if all the detents 42, 44, 46 can be rolled or embossed, then no knock-out regions (openings 101-103) are necessary. When the detents 42, 44, 46 are spaced apart from the shoulders 109, 110 of track 134, then the openings 101-103 are needed to avoid crimping, shrinkage, creasing, etc. at the track.

In a non-limiting exemplary embodiment, track 134 has a first opening 101 and a second opening 102.

In a non-limiting exemplary embodiment, track 134 has a first opening 101, a second opening 102, and a third opening 103.

In a non-limiting exemplary embodiment, basically the tracks have 1.5 inch hat (reinforcement) sections (e.g., first track side wall 38 and/or second track side wall 40) built into it at twenty-four inches on center to reinforce a wall panel. The interior hat sections are ⅞ inches matching two inches on center. The wall panel may be connected to the bottom track and built in. This wall panel can be used also as a finished exterior. The method of attachment is screwed on each side of the built in hat section. The studs 12 rise six inches above the wall panel for a shear connection for roof trusses. In the case of floor joists, the studs 12 can be two inches on center for a multi-story building and the end walls are four inches on center. This also provides space for extra insulation. Wall thickness can be up to eight and ⅜ inches providing standard R25 or R30 insulation. It also provides a mechanism of attachment totally around a perimeter of interior or exterior surfaces for 24 inches or 16 inches on center depending on loads applied to the system 10.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A support wall frame system for providing increased shear strength thereby preventing twisting and racking of a support wall, said support wall frame system comprising:
- at least one end track; and
- a frame member received within said at least one end track and including an elongated stud having a stud base with a first stud side wall and a second stud side wall, said elongated stud including a first rib located along said first stud side wall and a second rib located along said second stud side wall; wherein said stud base is intercalated between said first rib and said second rib;
- wherein said at least one end track includes a bottom end track and a top end track spaced therefrom, each of said bottom end track and said top end track including a track base having a first track side wall and a second track side wall, said first track side wall having an inwardly directed first detent and said second track side wall having an inwardly directed second detent;
- wherein each of said first detent and said second detent is extended along a major longitudinal height of said first track side wall and said second track side wall, respectively;
- wherein each of said bottom end track and said top end track includes
  - a first opening disposed along a first shoulder of said track base and said first track side wall, and
  - a second opening disposed along a second shoulder of said track base and said second track side wall;
- wherein each of said bottom end track and said top end track further includes a third opening disposed along said track base, said third opening having axially opposed ends directly abutted to said first opening and said second opening.

2. The support wall frame system of claim 1, wherein said first opening is contiguous with said first detent and said first shoulder.

3. The support wall frame system of claim 2, wherein said first opening comprises:
- a first rectilinear section located entirely at said first track side wall, said first rectilinear section being directly abutted with said first detent and oriented parallel thereto along an x-axis;
- a first horizontal rectilinear section located entirely along said first shoulder, said first horizontal rectilinear section being directly abutted with said first rectilinear section and oriented parallel to a y-axis; and
- a second rectilinear section located entirely at said track base, said second rectilinear section being oriented perpendicular thereto along a z-axis.

4. The support wall frame system of claim 3, wherein said first rectilinear section and said second rectilinear section intersect a center of said first horizontal section.

5. The support wall frame system of claim 1, wherein said second opening is contiguous with said second detent and said second shoulder.

6. The support wall frame system of claim 5, wherein said second opening comprises:
- a third rectilinear section located entirely at said second track side wall, said third rectilinear section being directly abutted with said second detent and oriented parallel thereto along an x-axis;

a second horizontal rectilinear section located entirely along said second shoulder, said second horizontal rectilinear section being directly abutted with said third rectilinear section and oriented parallel to a y-axis; and a fourth rectilinear section located entirely at said track base, said fourth rectilinear section being oriented perpendicular thereto along a z-axis.

7. The support wall frame system of claim 6, wherein said third rectilinear section and said fourth rectilinear section intersect a center of said second horizontal section.

8. The support wall frame system of claim 1, wherein said third opening is rectilinear and extends along an entire width of said track base.

9. A support wall frame system for providing increased shear strength thereby preventing twisting and racking of a support wall, said support wall frame system comprising:

at least one end track; and a frame member received within said at least one end track and including an elongated stud having a stud base with a first stud side wall and a second stud side wall, said elongated stud including a first rib located along said first stud side wall and a second rib located along said second stud side wall; wherein said stud base is intercalated between said first rib and said second rib;

wherein said at least one end track includes a bottom end track and a top end track spaced therefrom, each of said bottom end track and said top end track including a track base having a first track side wall and a second track side wall, said first track side wall having an inwardly directed first detent and said second track side wall having an inwardly directed second detent;

wherein each of said first detent and said second detent is extended along a major longitudinal height of said first track side wall and said second track side wall, respectively;

wherein each of said bottom end track and said top end track includes a first opening disposed along a first shoulder of said track base and said first track side wall, and a second opening disposed along a second shoulder of said track base and said second track side wall;

wherein said first opening and said second opening each has a substantially cross-shape.

10. The support wall frame system of claim 9, wherein said first opening is contiguous with said first detent and said first shoulder.

11. The support wall frame system of claim 10, wherein said first opening comprises:

a first rectilinear section located entirely at said first track side wall, said first rectilinear section being directly abutted with said first detent and oriented parallel thereto along an x-axis;

a first horizontal rectilinear section located entirely along said first shoulder, said first horizontal rectilinear section being directly abutted with said first rectilinear section and oriented parallel to a y-axis; and a second rectilinear section located entirely at said track base, said second rectilinear section being oriented perpendicular thereto along a z-axis.

12. The support wall frame system of claim 11, wherein said first rectilinear section and said second rectilinear section intersect a center of said first horizontal section.

13. The support wall frame system of claim 9, wherein said second opening is contiguous with said second detent and said second shoulder.

14. The support wall frame system of claim 13, wherein said second opening comprises:

a third rectilinear section located entirely at said second track side wall, said third rectilinear section being directly abutted with said second detent and oriented parallel thereto along an x-axis;

a second horizontal rectilinear section located entirely along said second shoulder, said second horizontal rectilinear section being directly abutted with said third rectilinear section and oriented parallel to a y-axis; and a fourth rectilinear section located entirely at said track base, said fourth rectilinear section being oriented perpendicular thereto along a z-axis.

15. The support wall frame system of claim 14, wherein said third rectilinear section and said fourth rectilinear section intersect a center of said second horizontal section.

16. The support wall frame system of claim 9, wherein each of said bottom end track and said top end track further includes a third opening disposed along said track base, said third opening having axially opposed ends directly abutted to said first opening and said second opening.

17. The support wall frame system of claim 16, wherein said third opening is rectilinear and extends along an entire width of said track base.

* * * * *